US010874574B1

(12) United States Patent
Ruby et al.

(10) Patent No.: US 10,874,574 B1
(45) Date of Patent: Dec. 29, 2020

(54) PATIENT EXAMINATION SYSTEM

(71) Applicant: Krug Inc., Kitchener (CA)

(72) Inventors: Leonard Ruby, Waterloo (CA); Cesar Fernandes, Cambridge (CA); Kyunghun Park, Waterloo (CA)

(73) Assignee: Krug Inc., Ontario (CA)

( * ) Notice: Subject to any disclaimer, the term of this patent is extended or adjusted under 35 U.S.C. 154(b) by 9 days.

(21) Appl. No.: 16/287,264

(22) Filed: Feb. 27, 2019

Related U.S. Application Data

(60) Provisional application No. 62/635,599, filed on Feb. 27, 2018.

(51) Int. Cl.

| | |
|---|---|
| ***A47G 5/02*** | (2006.01) |
| ***A47C 1/03*** | (2006.01) |
| ***A47C 7/54*** | (2006.01) |
| ***A61G 15/02*** | (2006.01) |
| ***A61G 13/00*** | (2006.01) |
| ***A61G 13/12*** | (2006.01) |
| ***A61G 5/02*** | (2006.01) |
| *A47C 1/034* | (2006.01) |
| *A61G 13/06* | (2006.01) |
| *A61G 13/08* | (2006.01) |

(52) U.S. Cl.
CPC ..... *A61G 15/02* (2013.01); *A47C 1/0308* (2018.08); *A47C 7/543* (2013.01); *A61G 5/025* (2013.01); *A61G 13/0018* (2013.01); *A61G 13/125* (2013.01); *A61G 13/129* (2013.01); *A47C 1/0342* (2013.01); *A61G 13/06* (2013.01); *A61G 13/08* (2013.01); *A61G 2200/322* (2013.01); *A61G 2200/325* (2013.01); *A61G 2200/327* (2013.01); *A61G 2200/34* (2013.01)

(58) Field of Classification Search
CPC .. A61G 5/125; A61G 13/1235; A47C 1/0308; A47C 7/543
See application file for complete search history.

(56) References Cited

U.S. PATENT DOCUMENTS

| | | | | |
|---|---|---|---|---|
| 583,136 | A * | 5/1897 | Anderson | A47C 17/12 5/26.1 |
| 3,083,996 | A | 4/1963 | Caldemeyer et al. | |
| 3,845,945 | A | 11/1974 | Lawley et al. | |
| 4,494,259 | A | 1/1985 | Miller et al. | |
| 4,612,679 | A | 9/1986 | Mitchell | |

(Continued)

*Primary Examiner* — Timothy J Brindley

(57) ABSTRACT

A patient examination system for locating a patient above a floor. The patient examination system includes a frame assembly, one or more motion-controlling assemblies connected to the frame assembly for moving one or more selected movable portions of the frame assembly, and a patient support assembly that is supported by the frame assembly. The patient support assembly includes a seat subassembly, a back subassembly, a footrest subassembly, and a cover element covering a seat cushion and a footrest cushion in the footrest subassembly. The cover element has an exposed surface formed for engagement with the patient. The seat subassembly supports the seat cushion and is secured to the upper element of the frame assembly. The frame assembly is configured to support the seat subassembly relative to the floor in a lowered position thereof, in a raised position thereof, in intermediate seat positions therebetween, and in Trendelenburg positions.

9 Claims, 33 Drawing Sheets

(56) References Cited

U.S. PATENT DOCUMENTS

| | | | | |
|---|---|---|---|---|
| 4,660,883 | A | 4/1987 | Kowalski | |
| 4,941,709 | A | 7/1990 | Moller | |
| D379,409 | S | 5/1997 | Schwaegerle et al. | |
| 5,862,549 | A | 1/1999 | Morton et al. | |
| 6,039,402 | A * | 3/2000 | Nemoto | B60N 2/02 296/65.05 |
| 6,089,593 | A * | 7/2000 | Hanson | A61G 5/006 280/250.1 |
| 6,135,559 | A | 10/2000 | Kowalski | |
| 6,336,235 | B1 | 1/2002 | Ruehl | |
| 6,460,930 | B2 * | 10/2002 | Thornton | A61G 5/006 297/173 |
| 6,637,812 | B2 * | 10/2003 | Laughlin | A47C 4/02 297/118 |
| 6,886,196 | B2 * | 5/2005 | Nygren | A47C 21/08 5/426 |
| 6,928,673 | B2 | 8/2005 | Risk, Jr. | |
| 7,024,711 | B1 | 4/2006 | Stasney et al. | |
| 7,475,944 | B2 | 1/2009 | Griepentrog et al. | |
| 7,644,991 | B2 | 1/2010 | Davis et al. | |
| 7,708,347 | B2 | 5/2010 | Griepentrog et al. | |
| 9,848,704 | B1 | 12/2017 | Pollard et al. | |
| 2013/0307308 | A1 * | 11/2013 | Hankins | A61G 5/125 297/411.38 |
| 2015/0342805 | A1 | 12/2015 | Harris, Jr. | |
| 2016/0135602 | A1 * | 5/2016 | Smith | A47B 83/021 297/115 |

* cited by examiner

PATIENT EXAMINATION SYSTEM

CROSS-REFERENCE TO RELATED APPLICATION

This application claims the benefit of U.S. Provisional Patent Application No. 62/635,599, filed on Feb. 27, 2018, the entirety of which is hereby incorporated by reference.

FIELD OF THE INVENTION

The present invention is a patient examination system.

BACKGROUND OF THE INVENTION

As is well known in the art, two separate items of clinical furniture are needed in order to accommodate the variety of positions which may be requested of a patient. In the prior art, an examination table is used to support the patient in prone, supine, or side-lying positions. An examination chair typically is used to support the patient in a seated or semi-supine position. The need to have two separate items of furniture has a number of disadvantages, e.g., a room in which the patient is examined is usually required to be sufficiently large to accommodate the two furniture items, as well as other equipment.

Legislation in various jurisdictions has imposed a number of requirements on furniture and equipment used in connection with medical care. For example, in the United States, the Americans with Disabilities Act ("ADA") imposes a number of requirements, and in the prior art, compliance with certain of the requirements in regard to clinical furniture has been found to be challenging.

SUMMARY OF THE INVENTION

For the foregoing reasons, there is a need for a patient examination system that overcomes or mitigates one or more of the defects or disadvantages of the prior art. Such defects or disadvantages are not necessarily included in those described above.

In its broad aspect, the invention provides a patient examination system for locating a patient above a floor supporting the patient examination system. The patient examination system includes a frame assembly having one or more lower elements at least partially defining a lower side of the frame assembly located proximal to the floor, and one or more motion-controlling assemblies connected to the frame assembly for moving one or more selected movable portions of the frame assembly relative to the floor. The selected movable portions include an upper element defining an upper side of the frame assembly located distal to the floor, the upper element being movable by the motion-controlling assemblies relative to the lower element.

The patient examination system also includes a patient support assembly, which has a seat subassembly with a seat cushion, a back subassembly with a back cushion, a footrest subassembly with a footrest cushion, and a cover element covering the seat cushion and the footrest cushion, the cover element having an exposed surface formed for engagement with the patient. The seat subassembly supports the seat cushion and is secured to the upper element of the frame assembly.

The frame assembly is configured to support the seat subassembly relative to the floor in a lowered position thereof, in a raised position thereof, in intermediate seat positions therebetween, and in one or more Trendelenburg positions. The back subassembly supports the back cushion and is connected with the upper element by a back linkage subassembly. The back linkage subassembly is configured to support the back subassembly relative to the frame assembly in a non-horizontal position thereof, in a horizontal position thereof, in intermediate back positions therebetween, and in one or more Trendelenburg positions.

The footrest subassembly is connected to the upper element of the frame assembly by a footrest linkage subassembly. The footrest linkage subassembly supports the footrest cushion. The footrest linkage subassembly also is configured to support the footrest subassembly relative to the seat subassembly in a retracted position thereof in which the footrest cushion is positioned orthogonally to the upper element, and in an extended position thereof, in which the footrest cushion is positioned parallel to the upper element.

BRIEF DESCRIPTION OF THE DRAWINGS

The invention will be better understood with reference to the attached drawings, in which.

DETAILED DESCRIPTION

Figure 1A:
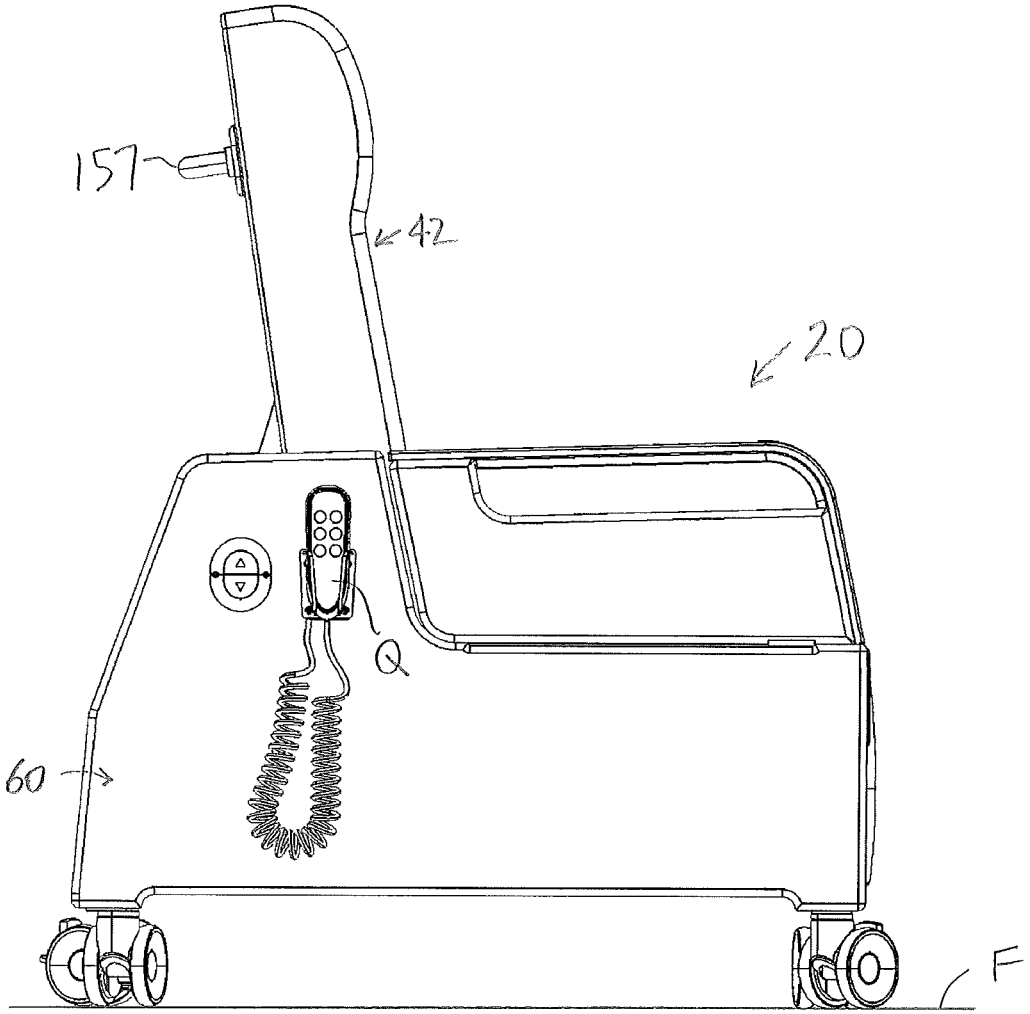
FIG. 1A is a right side view of an embodiment of the patient examination system of the invention.
Figure 1B:
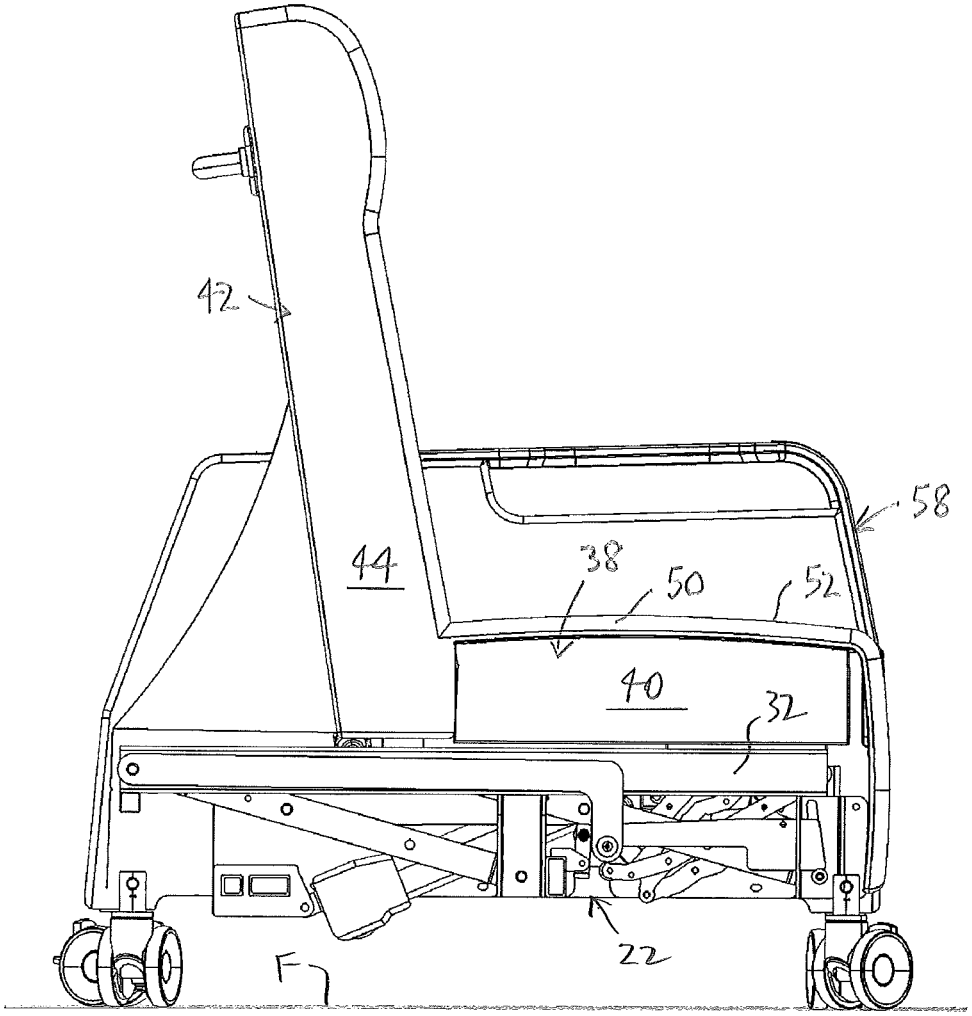
FIG. 1B is a right side view of the patient examination system of FIG. 1A, with certain elements omitted in order to show an embodiment of the frame assembly of the invention in a retracted condition thereof.

In the attached drawings, like reference numerals designate corresponding elements throughout. Reference is first made to FIGS. 1A-9D to describe an embodiment of a patient examination system of the invention indicated generally by the numeral 20. As will be described, the patient examination system for locating a patient (not shown) above a floor "F" supporting the patient examination system 20. In one embodiment, the patient examination system 20 preferably includes a frame assembly 22 (FIGS. 1B, 3B, 3C, 5B, 5C) having one or more lower elements 24 (FIGS. 3B, 5B) at least partially defining a lower side 26 of the frame assembly 22 that is located proximal to the floor "F". Preferably, the patient examination system 20 also includes one or more motion-controlling assemblies 28 (FIG. 5B) connected to the frame assembly 22 for moving one or more selected movable portions 30 of the frame assembly 22 relative to the floor "F". It is also preferred that the selected movable portions 30 include an upper element 32 defining an upper side 34 of the frame assembly 22 that is located distal to the floor "F". As will be described, the upper element 32 preferably is movable by the motion-controlling assembly 28 relative to the lower element 24.

Figure 3A:
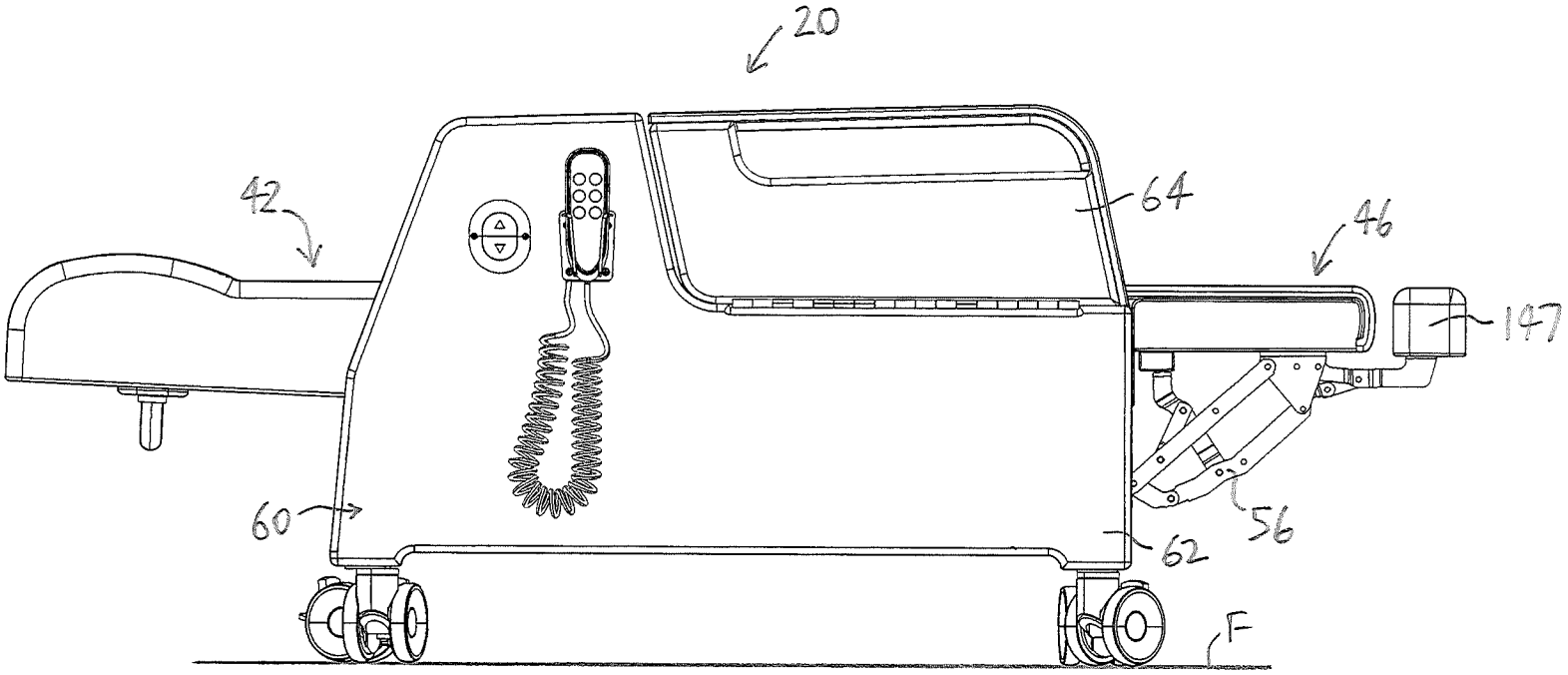
FIG. 3A is a right side view of the patient examination system of FIG. 1A in which the frame assembly is in the retracted condition and a back subassembly is in a substantially horizontal position.
Figure 3B:
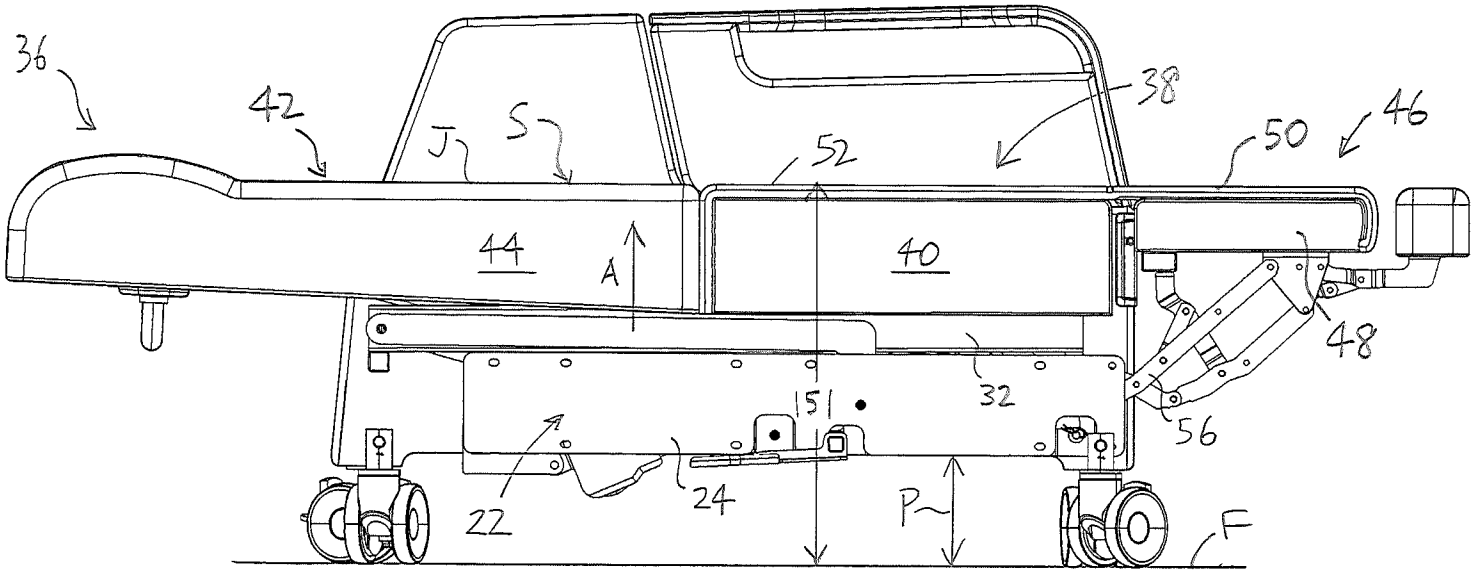
FIG. 3B is a right side view of the patient examination system of FIG. 3A in which certain elements are omitted in order to show the frame assembly in the retracted condition thereof.
Figure 3C:
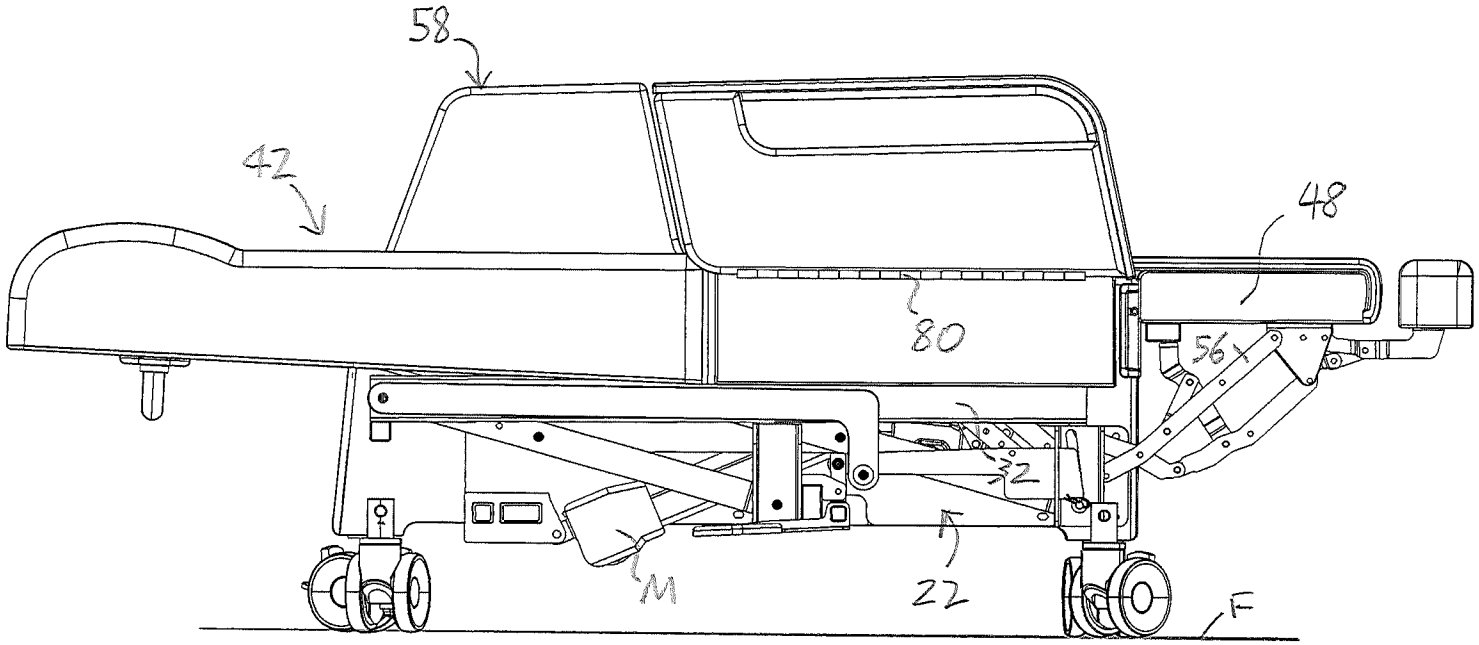
FIG. 3C is a right side view of the patient examination system of FIG. 3B in which another element is omitted.
Figure 3D:
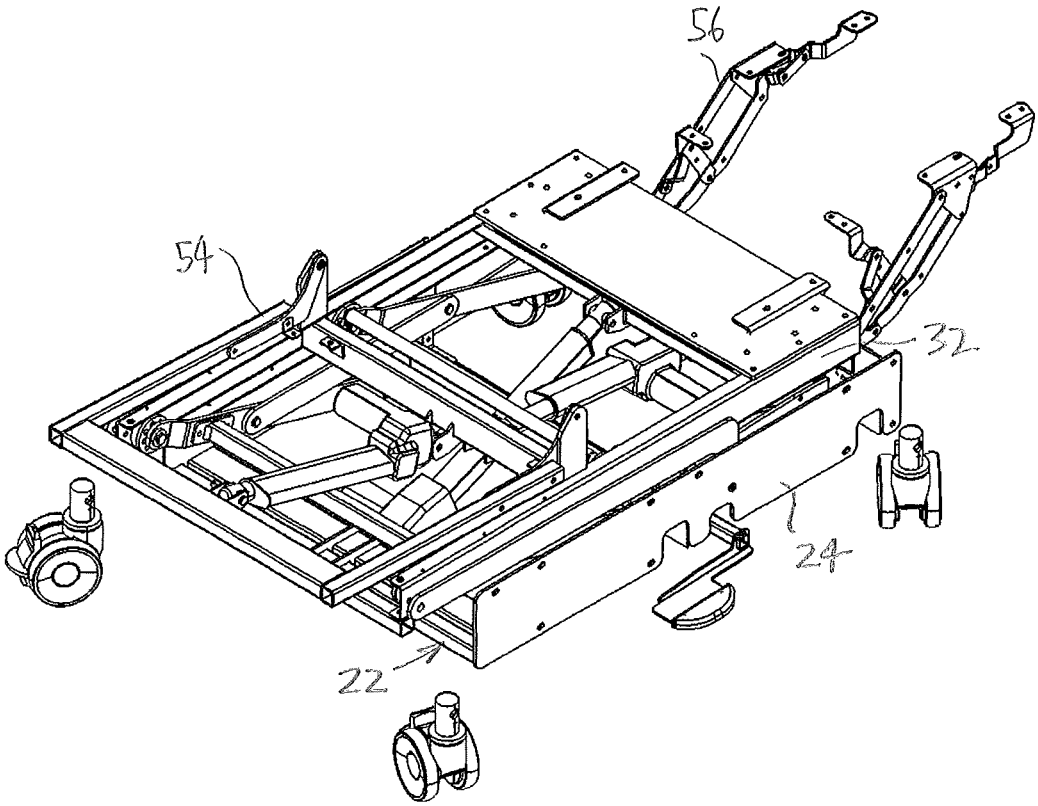
FIG. 3D is an isometric view of the frame assembly in the retracted condition thereof, along with certain additional elements, drawn at a smaller scale.
Figure 4:
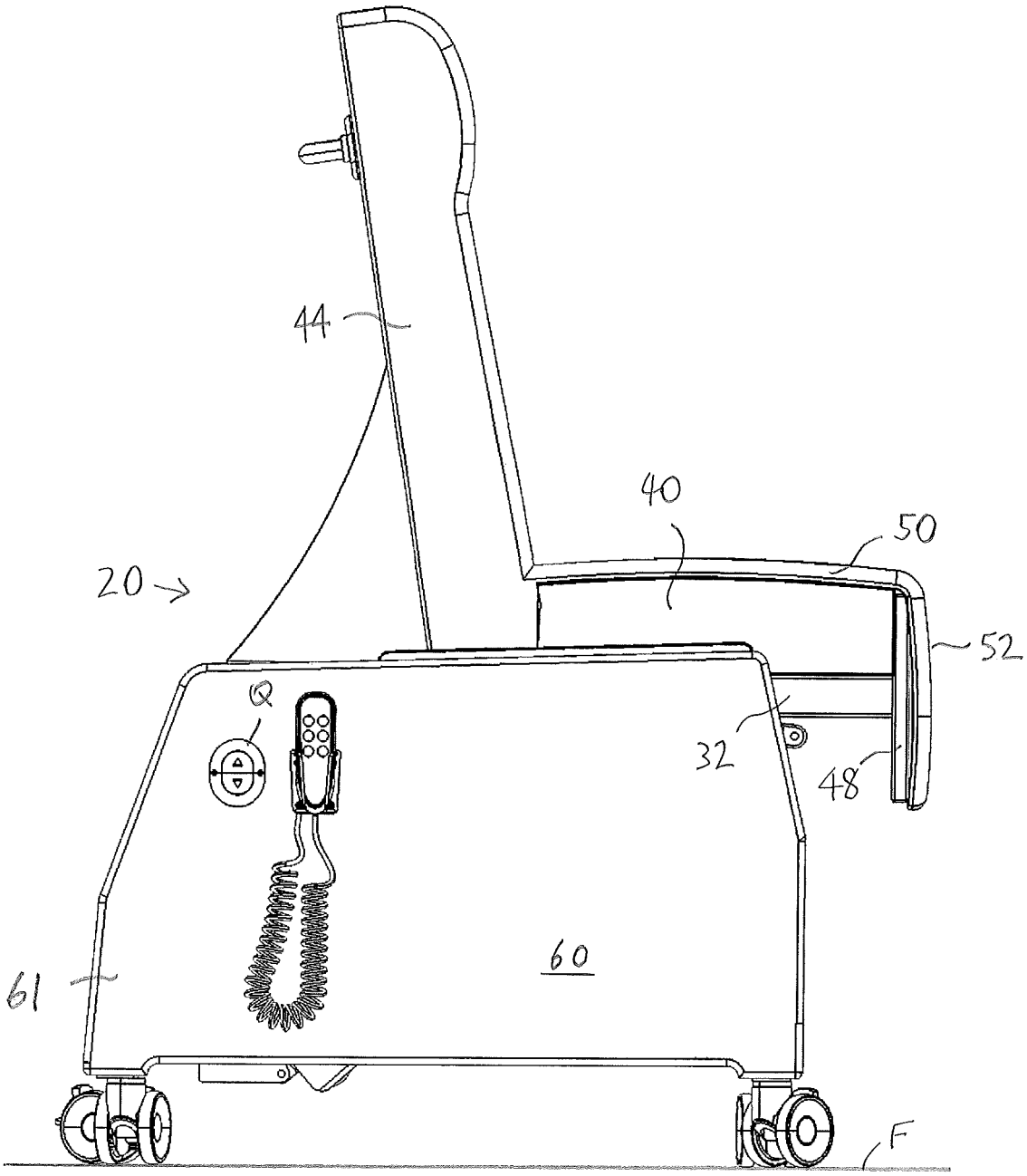
FIG. 4 is a right side view of the patient examination system of FIG. 1A in which the frame assembly is in an extended condition, drawn at a larger scale.
Figure 5A:
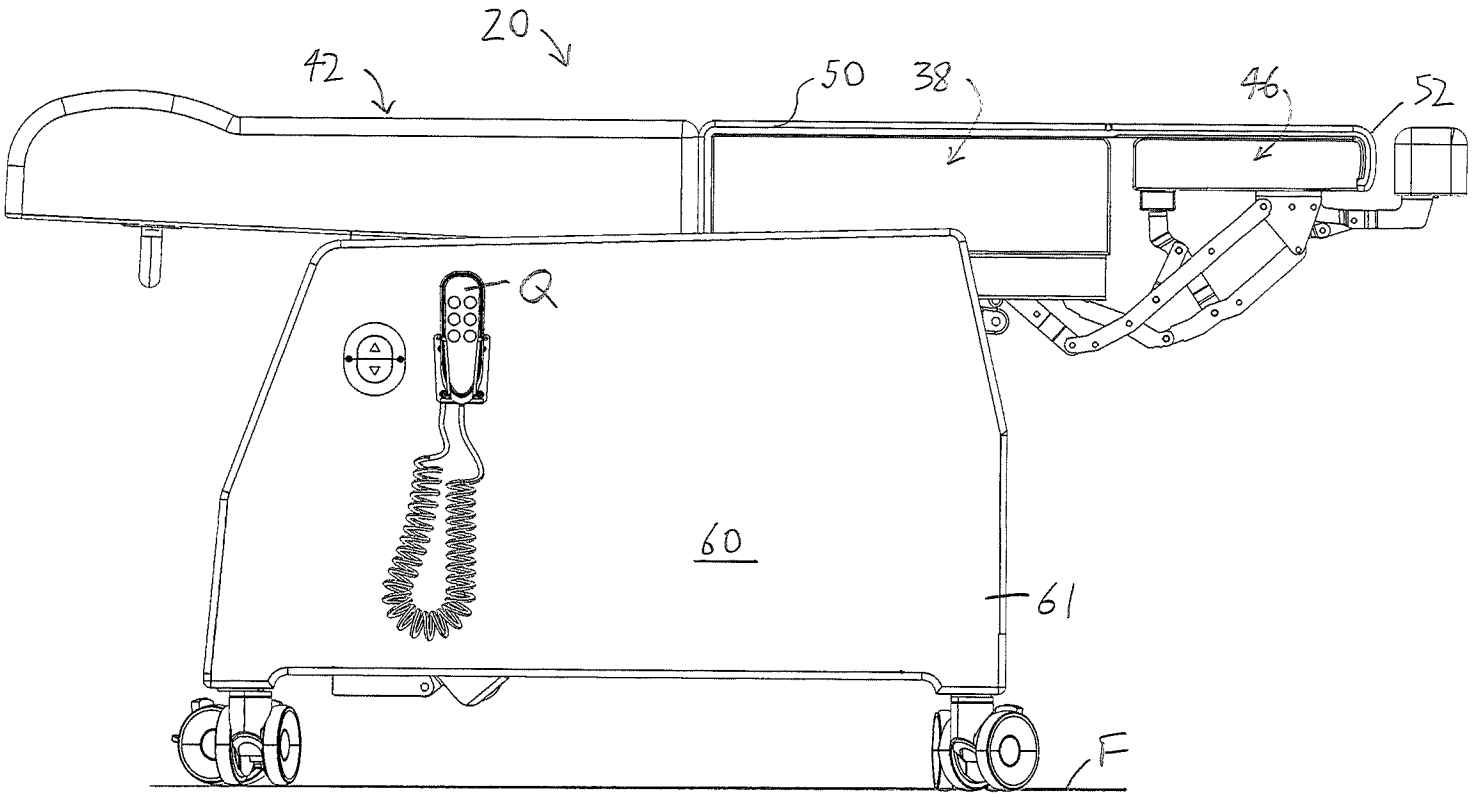
FIG. 5A is a right side view of the patient examination system of FIG. 1A in which the back subassembly is in the horizontal position and the frame assembly is in the extended condition.
Figure 5B:
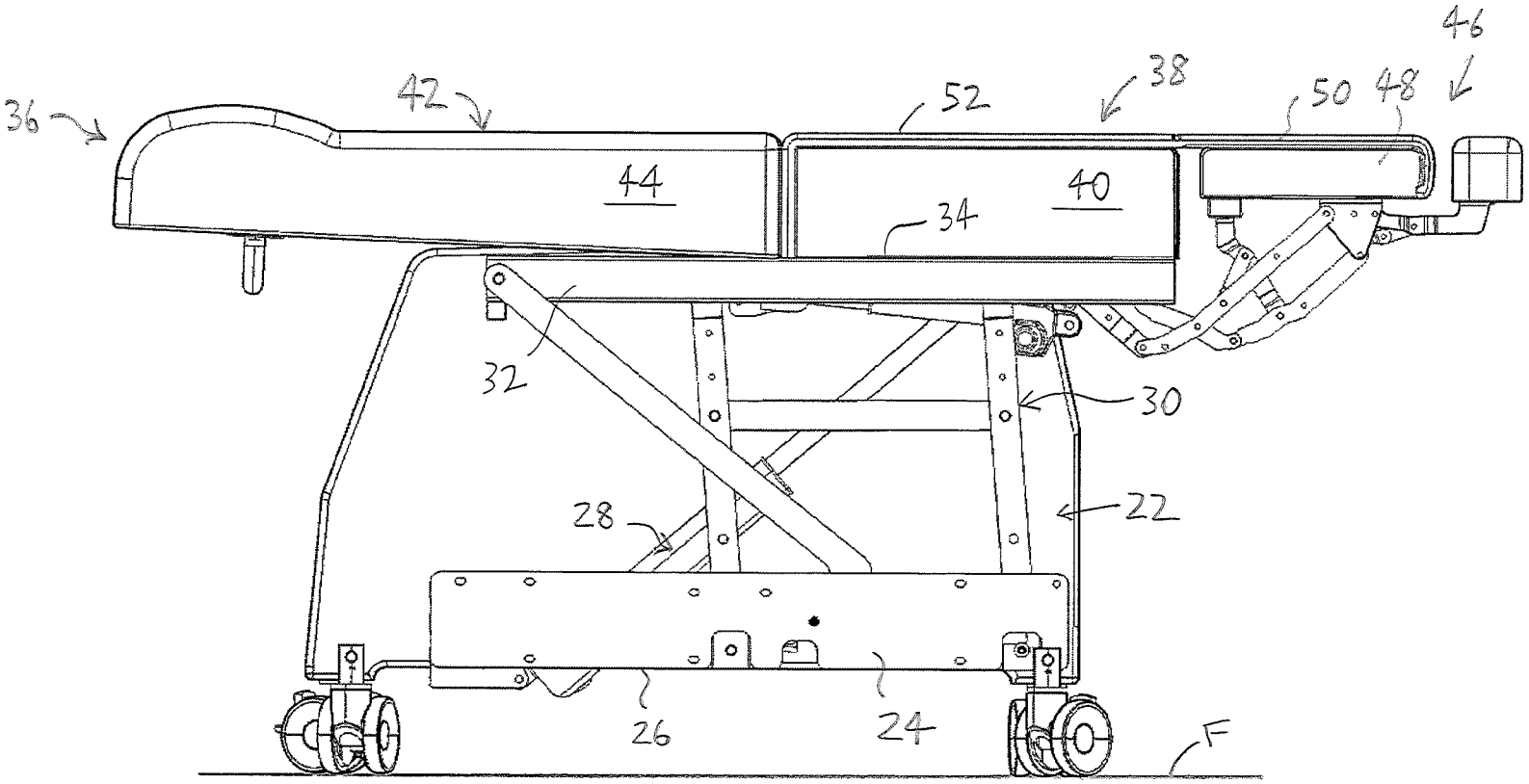
FIG. 5B is a right side view of the patient examination system of FIG. 5A, with certain elements omitted to show the frame assembly in the extended condition.
Figure 9A:
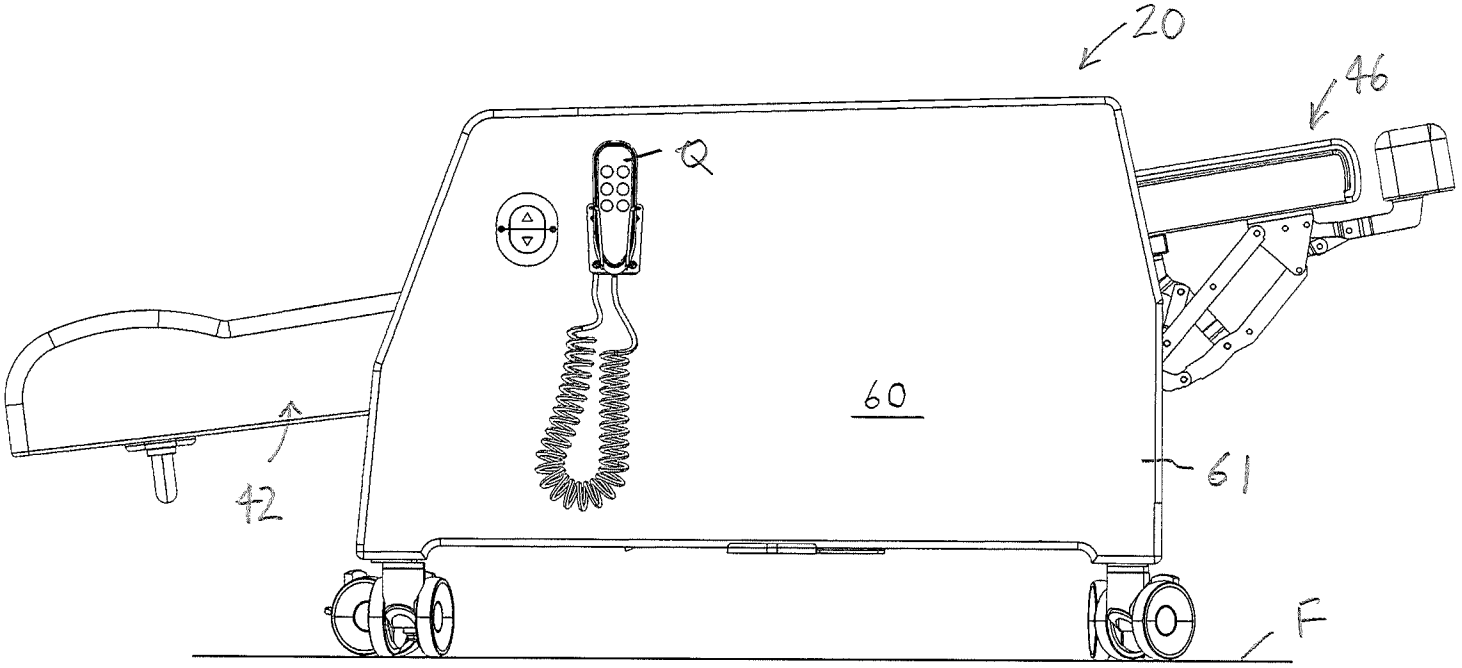
FIG. 9A is a right side view of the patient examination system of FIG. 1A in a Trendelenburg position.
Figure 9B:
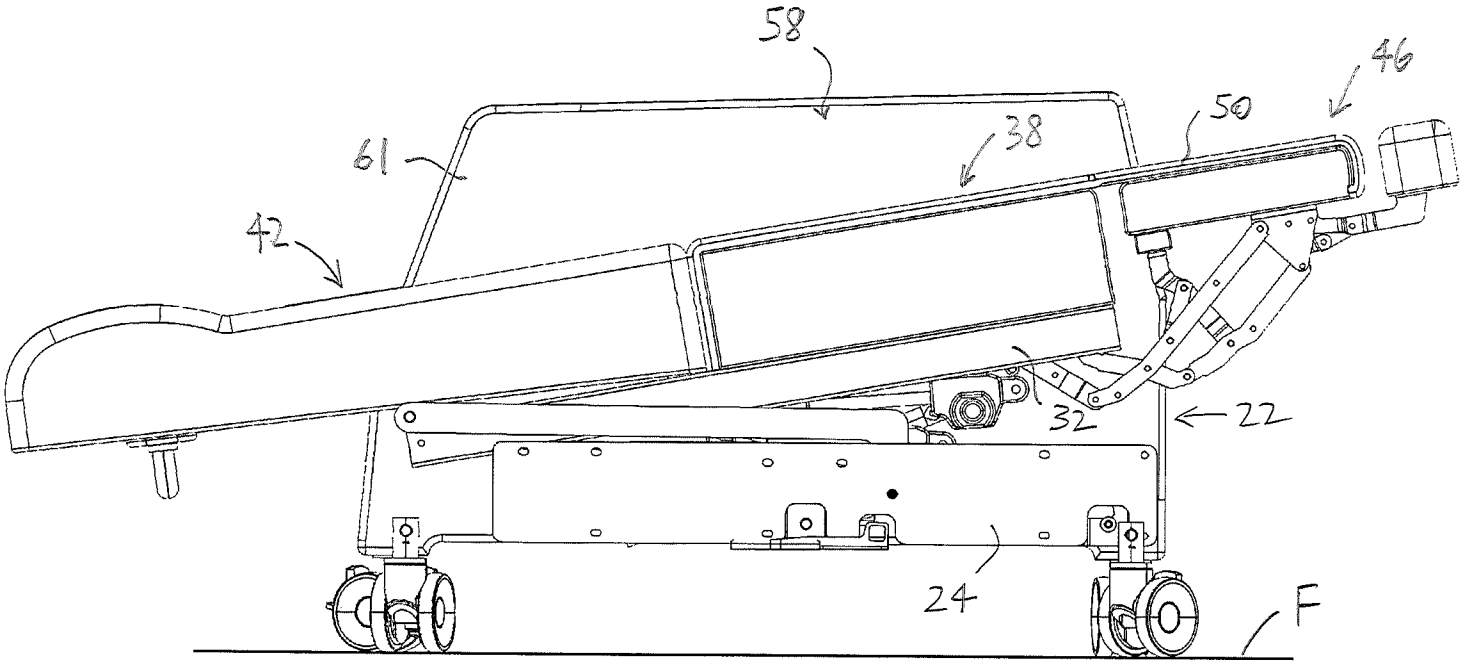
FIG. 9B is a right side view of the patient examination system of FIG. 9A with certain elements omitted, in order to show the frame assembly.
Figure 9C:
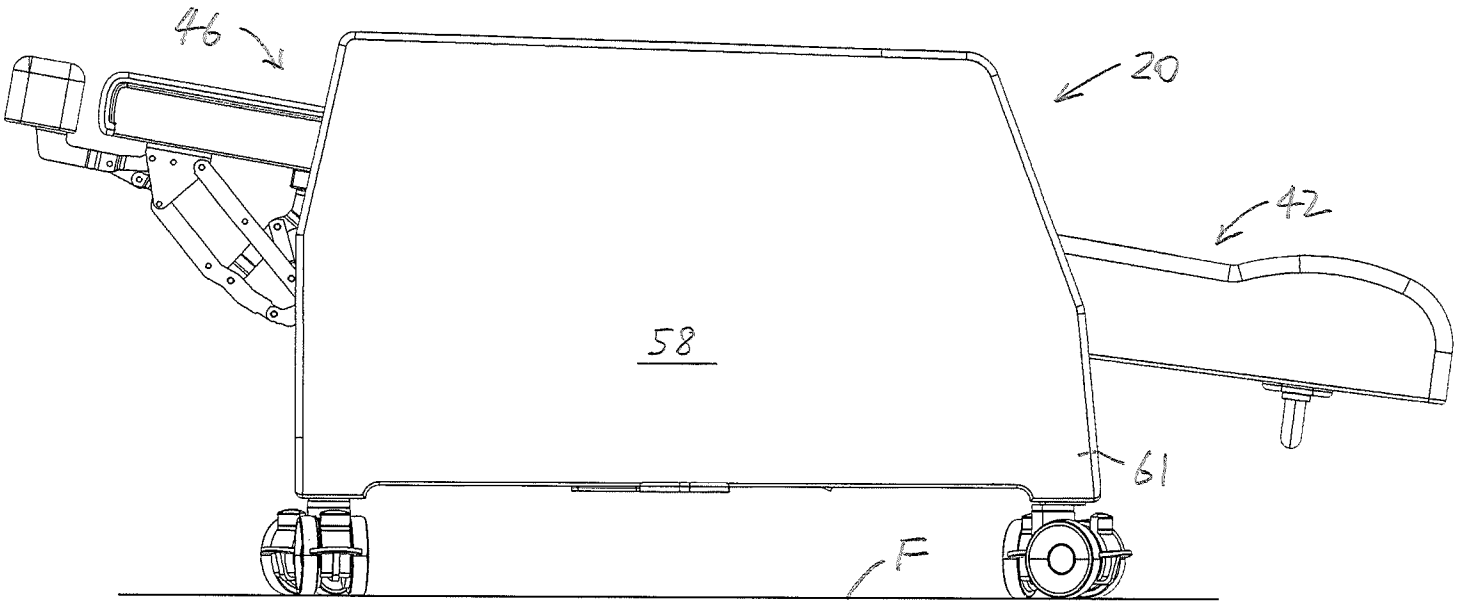
FIG. 9C is a left side view of the patient examination system as illustrated in FIGS. 9A and 9B.

As can be seen in FIGS. 3B and 5B, the patient examination system 20 preferably also includes a patient support assembly 36 including a seat subassembly 38 having a seat cushion 40, a back subassembly 42 having a back cushion 44, a footrest subassembly 46 having a footrest cushion 48, and a cover element 50 covering the seat cushion 40 and the footrest cushion 48. The cover element 50 preferably has an exposed surface 52 formed for engagement with the patient. It is preferred that the seat subassembly 38 supports the seat cushion 40 and is secured to the upper element 32 of the frame assembly 22, as will also be described. The frame assembly 22 is configured to support the seat subassembly 38 relative to the floor "F" in a lowered position thereof (FIG. 1A), in a raised position thereof (FIG. 4), in intermediate seat positions therebetween, and in one or more Trendelenburg positions (FIG. 9A). The back subassembly 42 preferably supports the back cushion 44 and is connected with the upper element 32 by a back linkage subassembly 54 (FIGS. 3D, 5E). The back linkage subassembly 54 is configured to support the back subassembly 42 relative to the frame assembly 22 in a non-horizontal position thereof (FIG. 1A), in a horizontal position thereof (FIG. 3A), in intermediate back positions therebetween, and in one or more Trendelenburg positions (FIG. 9A).

Figure 5C:
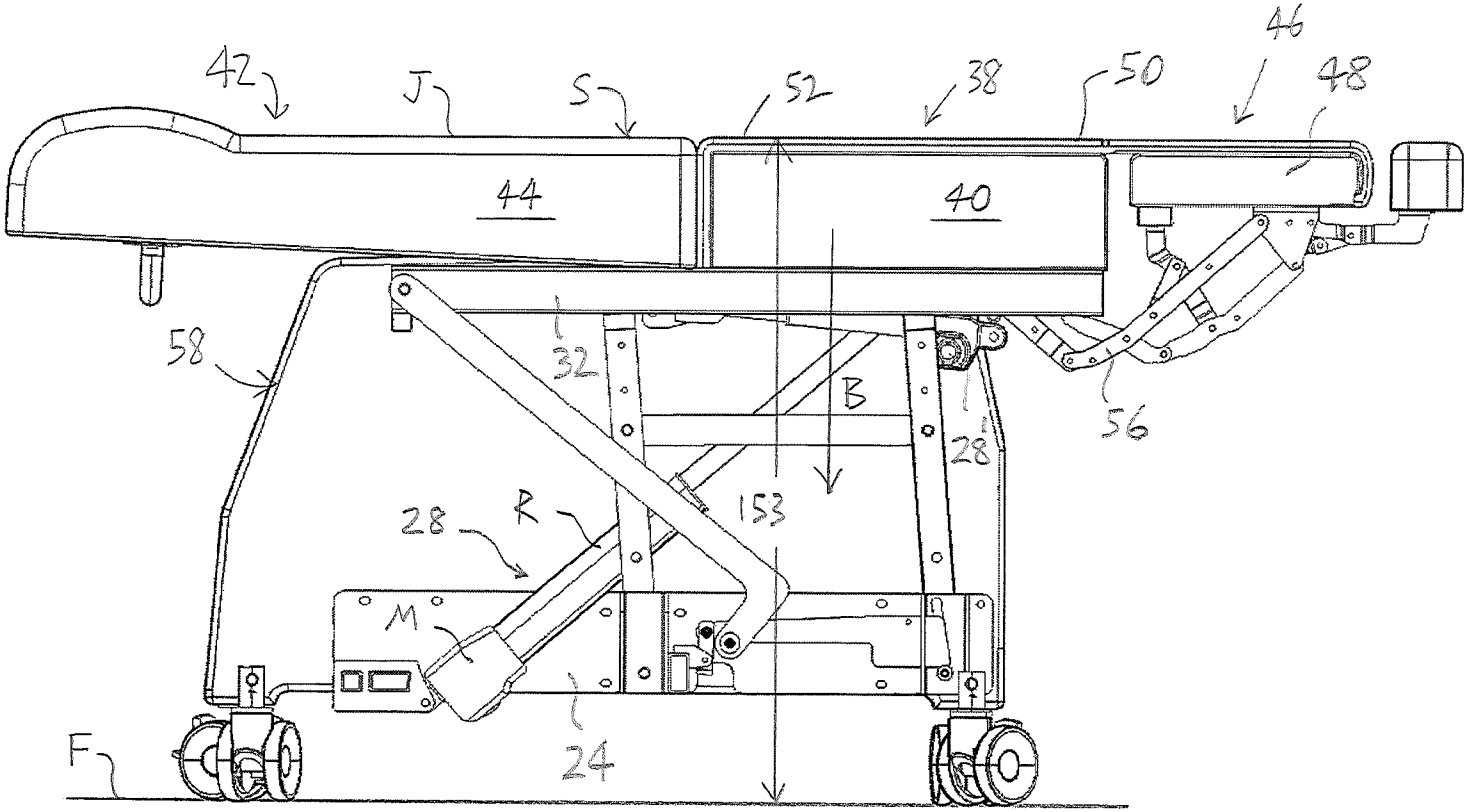
FIG. 5C is a right side view of the patient examination system of FIG. 5B, with certain additional elements omitted.
Figure 5D:
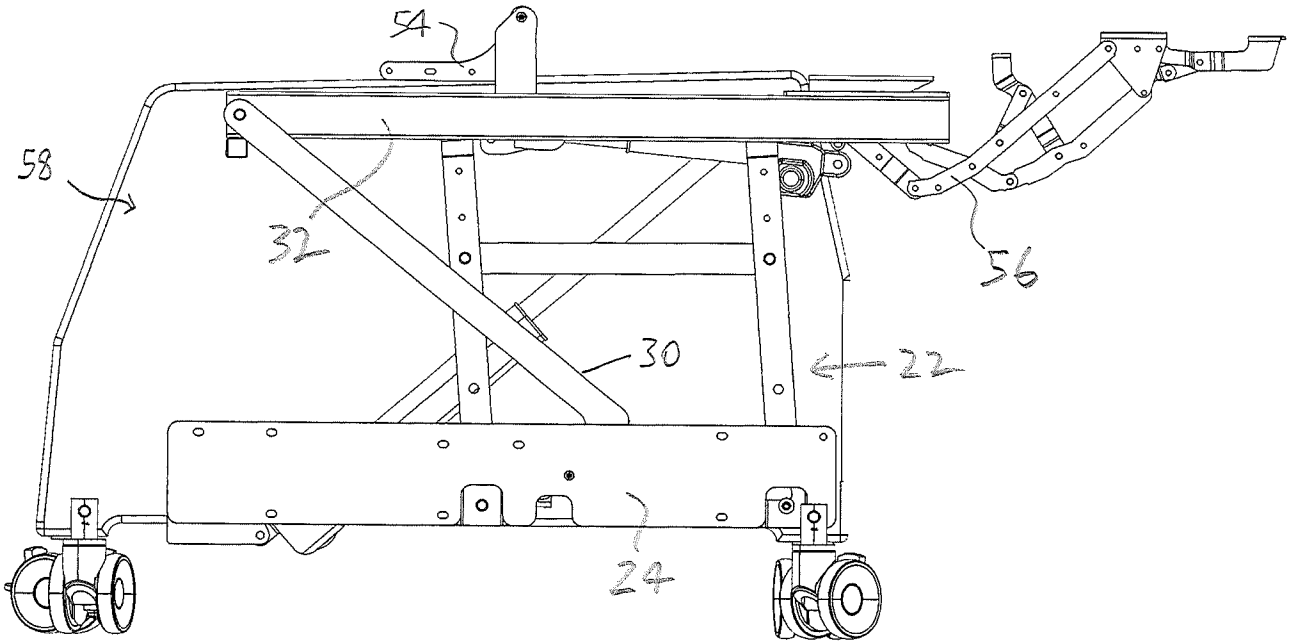
FIG. 5D is a right side view of the patient examination system of FIG. 5C, with certain elements omitted.
Figure 5E:
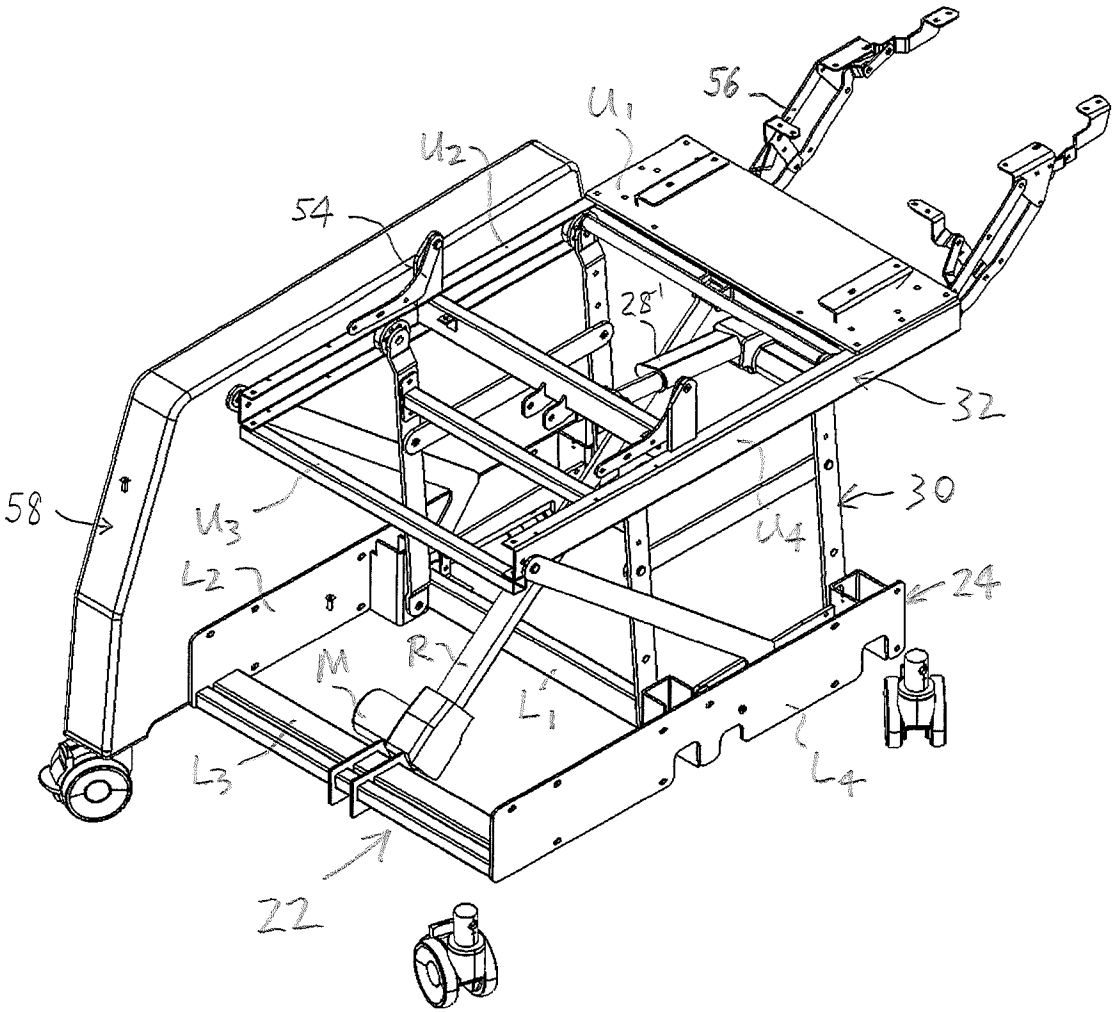
FIG. 5E is an isometric view of the patient examination system of FIG. 5A with certain elements omitted to show the frame assembly in the extended condition.
Figure 6:
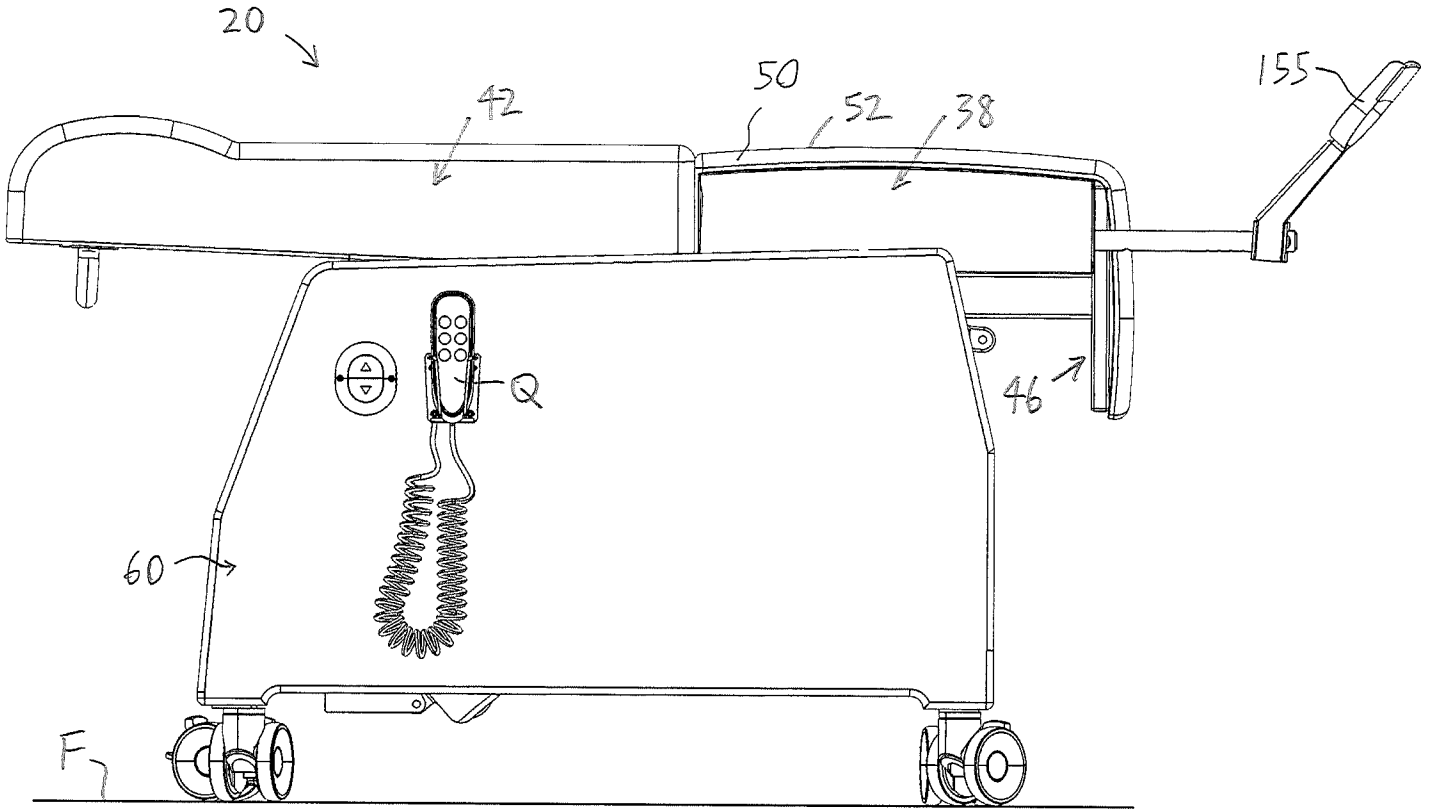
FIG. 6 is a right side view of the patient examination system of FIG. 5A in which the footrest subassembly is in a retracted position and stirrup elements are mounted to the seat subassembly.

It is also preferred that the footrest subassembly 46 is connected to the upper element 32 of the frame assembly 22 by a footrest linkage subassembly 56 (FIGS. 3D, 5C, 5E). The footrest linkage subassembly 56 supports the footrest cushion 48 (FIGS. 3C, 5C). The footrest linkage subassembly 56 preferably is configured to support the footrest subassembly 46 relative to the seat subassembly 38 in a retracted position thereof in which the footrest cushion 48 is positioned orthogonally to the upper element 32 (FIG. 4), and in an extended position thereof (FIGS. 3C, 5B, 5C), in which the footrest cushion 48 is positioned parallel to the upper element 32.

Those skilled in the art would appreciate that the one or more motion-controlling assemblies 28 may include any suitable means for initiating movement controllable by an operator or, if preferred, by a patient (not shown) for precise positioning of certain portions of the patient examination system 20, to locate the patient in one or more selected positions. In one embodiment, the motion-controlling assembly 28 preferably is configured to move the upper element 32 vertically relative to the floor between lowered and raised positions thereof (FIGS. 3A, 5A). For example, in FIG. 3B, the frame assembly 22 is shown in a retracted condition, in which the upper element 32 is positioned proximal to the lower element 24. In FIGS. 5B and 5C, the frame assembly 22 is shown in an extended condition, in which the upper element 32 is positioned distal to the lower element 24. It will be understood that the frame assembly 22 may be moved to a number of intermediate conditions, in which the upper element 32 is located between its raised and lowered positions. As can also be seen, e.g., in FIG. 9B, the frame assembly 22 is also movable to a Trendelenburg position, in which the upper element 32 is positioned to define an acute angle between the upper element 32 and the floor "F". From the foregoing, it can be seen that the vertical movement of the upper element 32 causes corresponding vertical movement of the seat subassembly 38, the back subassembly 42, and the footrest subassembly 46.

Those skilled in the art would be aware of suitable motion-controlling assemblies. For instance, in one embodiment, the motion-controlling assembly may include one or more suitable motors "M" operatively coupled with a telescoping ram subassembly "R" (FIG. 5C). The motion-controlling assembly 28 preferably also includes one or more suitable controllers "Q" (FIGS. 1A, 5A).

For instance, in FIGS. 3B and 5C, it can be seen that, when the frame assembly 22 is moved from its retracted condition (FIG. 3B) to its extended condition (FIG. 5C), the upper element 32 is moved vertically upwardly, in the direction indicated by arrow "A" in FIG. 3B. Similarly, when the frame assembly 22 is moved from its extended condition (FIG. 5C), to its retracted condition (FIG. 3B), the upper element 32 is vertically lowered, as indicated by arrow "B" in FIG. 5C.

As noted above, the seat cushion 40, the back linkage subassembly 54, and the footrest linkage subassembly 56 are all mounted to the upper element 32. Accordingly, those skilled in the art would appreciate that movement of the upper element 32 also causes corresponding movement of each of the seat subassembly 38, the back subassembly 42, and the footrest subassembly 46.

As is known, in a Trendelenburg position, the patient is positioned with the pelvis higher than the head. Those skilled in the art would appreciate that, in order for the patient examination system 20 to be configured in a Trendelenburg position, for example, as shown in FIGS. 9A-9D, the upper element 32 is positioned at one or more acute angles relative to the lower element 24.

From the foregoing, it can be seen that the patient examination system 20 may be configured in a variety of selected states. For instance, in FIG. 1A, the system 20 is configured in a first sitting state, in which the patient is supported in a lowered sitting position. In FIG. 4, the system 20 is configured in a second sitting state, in which the patient is supported in a raised sitting position. It will be understood that the system 20 may be configured in a variety of intermediate positions, vertically intermediate between the lowered and raised seat cushion positions illustrated in FIGS. 1A and 4 respectively.

Those skilled in the art would appreciate that the reconfiguration of the system 20 from the first sitting state to the second sitting state, is the result of the frame assembly 22 being moved from its retracted condition (in which the seat subassembly 38 is in its lowered position) to its extended condition (in which the seat subassembly 38 is in its raised position).

It will be understood that the back cushion 44 is positionable in a lowered position of the back subassembly 42 (FIG. 3A), in which the back cushion 44 is substantially parallel to the upper element 32, and a raised position (FIG. 1A), in which the back cushion 44 is positioned to define an acute angle between the back cushion 44 and the upper element 32. As can be seen in FIGS. 3D and 5E, the back cushion 44 preferably is connected to the upper element 32 by the back linkage subassembly 54.

It will be understood that the upper element 32 may include a number of discrete elongate elements ("$U_1$"-"$U_4$") that are secured together (FIG. 5E). Similarly, the lower element 24 may include discrete elements ("$L_1$"-"$L_4$") that are secured together (FIG. 5E). The frame assembly 22 preferably also includes the movable portions 30 or intermediate elements that are located generally between the lower and upper elements 24, 32, to connect the lower and upper elements 24, 32. The intermediate elements 30 preferably are configured to provide parallel linkages or such other arrangements as are suitable to position the upper element 32 as desired relative to the lower element 24, using the one or more motion-controlling assemblies 28. As can be seen, e.g., in FIG. 5E, in one embodiment, the motion-controlling assembly 28 preferably includes a motor "M" mounted to the lower element and a telescoping ram "T" that is connected to the upper element 32, for vertical movement of the upper element 32 relative to the lower element 24. The frame assembly may include a second motion-controlling assembly 28', as can be seen in FIG. 5E.

Figure 8:
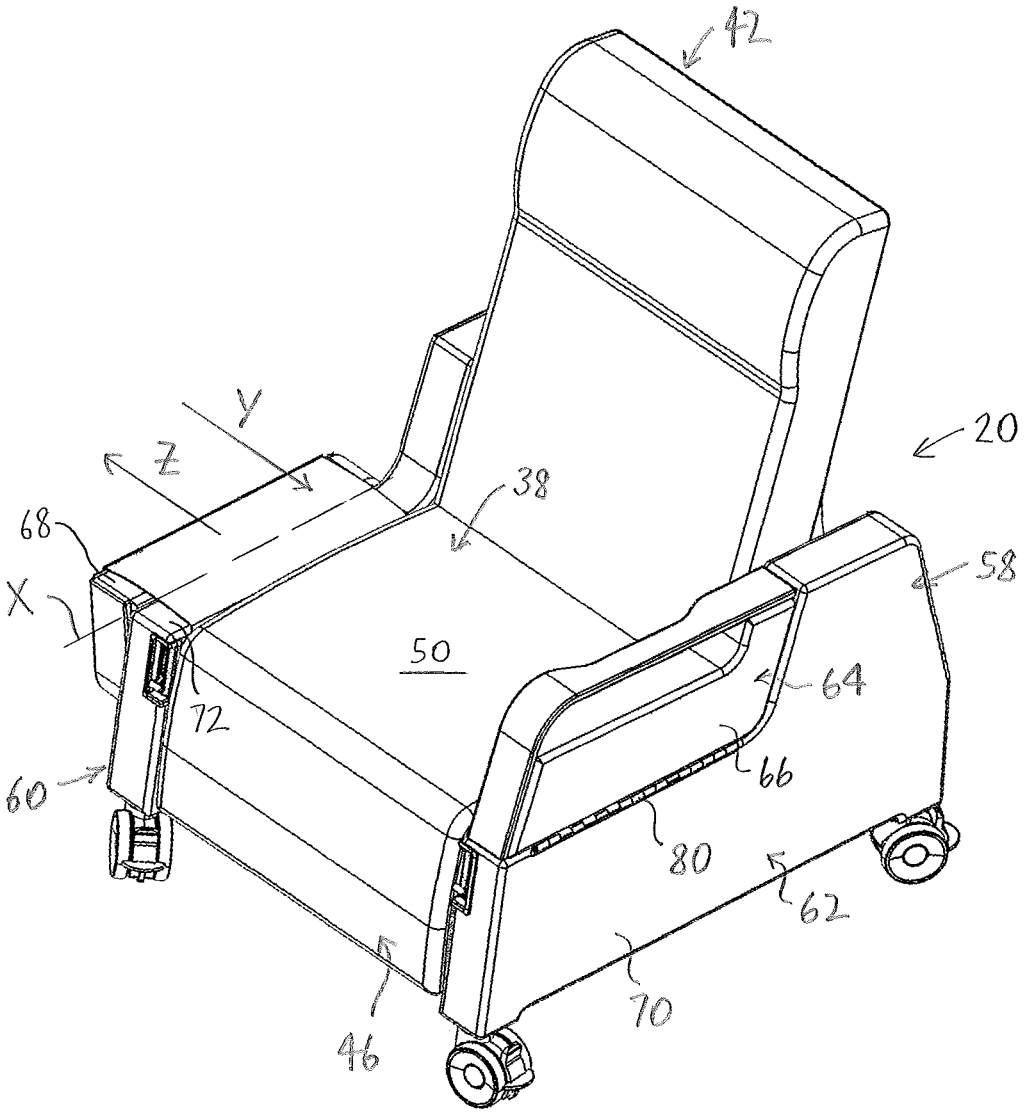
FIG. 8 is an isometric view of the patient examination system of FIG. 7.

In one embodiment, the patient examination system 20 preferably additionally includes a left arm assembly 58 and a right arm assembly 60 positioned on opposite sides of the seat subassembly 38 (FIG. 8). Preferably, each of the left and the right arm assemblies 58, 60 are secured to opposite sides of the lower element 24 of the frame assembly 22.

Figure 9D:
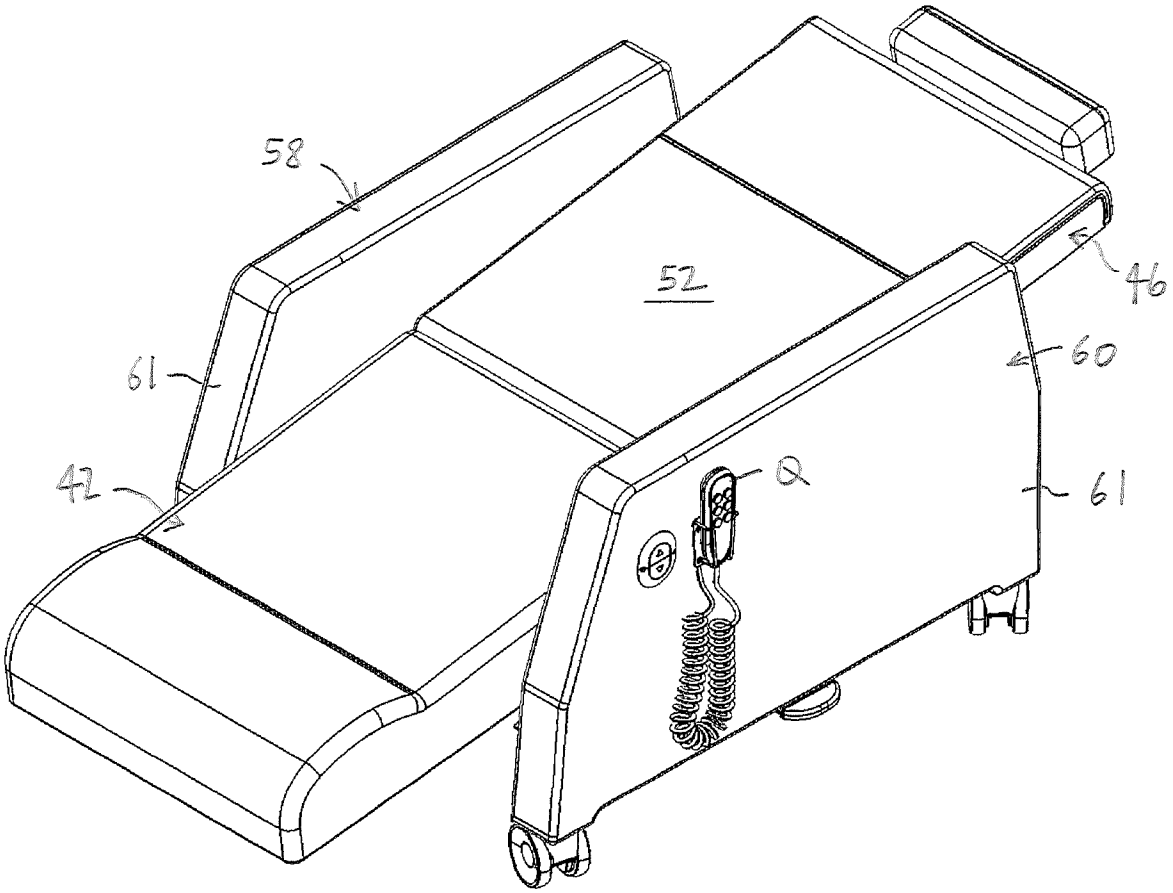
FIG. 9D is an isometric view of the patient examination system of FIGS. 9A-9C.

As can be seen, e.g., in FIGS. 4, 5A, and 9D, in one embodiment, each of the left and right arm assemblies 58, 60 preferably includes only one body portion 61.

However, in an alternative embodiment, it is preferred that each of the left and right arm assemblies 58, 60 includes a lower portion 62 secured to the lower element 24 of the frame assembly 22, and an upper portion 64 movable relative to the lower portion 62 between an aligned position thereof, in which the upper portion 64 is at least partially vertically aligned with the lower portion 62 above the lower portion 62, and a non-aligned position thereof (FIG. 8), in which the upper portion 64 is at least partially located beside the lower portion 62. Preferably, the upper portion 64 is movable between the aligned and non-aligned positions by pivoting about an axis of rotation "X" (FIG. 8). Each of the left and right arm assemblies 58, 60 preferably includes a hinge subassembly 80 configured for rotation of the upper portion 64 about the axis "X" defined by the hinge subassembly 80. As an example, in FIG. 8, the upper portion 64 of the right arm assembly 60 is shown in the non-aligned position thereof, and the upper portion 64 of the left arm assembly 58 is shown in the aligned position thereof.

Figure 7:
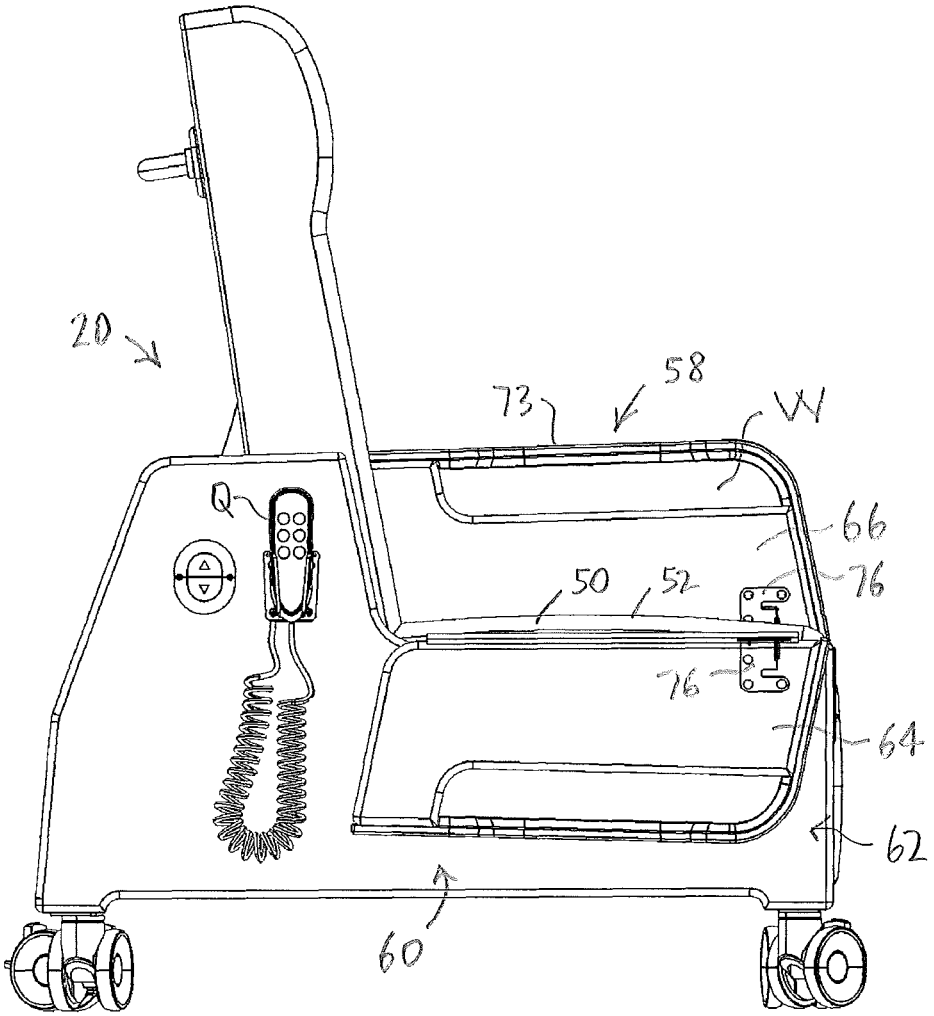
FIG. 7 is a right side view of the patient examination system of FIG. 1A, with an upper portion of a right arm assembly thereof in a non-aligned position and the frame assembly in the retracted condition.

The advantage of the left and right arm assemblies 58, 60 including respective upper and lower portions is that this arrangement facilitates generally horizontal movement of the patient onto and from the patient examination system 20. Specifically, and as can be seen in FIGS. 7 and 8, when the seat subassembly 38 is in the lowered position thereof and the upper portion 64 is in the non-aligned position thereof, the patient is substantially horizontally movable over the lower portion 62.

For instance, the patient may be moved in the direction indicated by arrow "Y" in FIG. 8 onto the seat subassembly 38. The patient may be moved in the direction indicated by arrow "Z" in FIG. 8 from the seat subassembly 38. Such movement may be, for example, onto another support device (not shown).

As illustrated in FIG. 8, in one embodiment, the upper portion 64 preferably includes an upper portion body 66 having an upper portion mating surface 68 and the lower portion 62 preferably includes a lower portion body 70 having a lower portion mating surface 72 that is formed to mate with the upper portion mating surface 68 when the upper portion 64 is in the aligned position. Preferably, when the upper portion 64 is in the non-aligned position and the seat subassembly 38 is in the lowered position, the upper portion mating surface 68 and the lower portion mating surface 72 are laterally aligned with each other, and also aligned with at least part of the exposed surface 52 of the cover element 50. In one embodiment, the upper portions 64 may each include an armrest element 73 (FIG. 7) defining a gap "W" between the armrest element 73 and the upper portion body 66.

Figure 10:
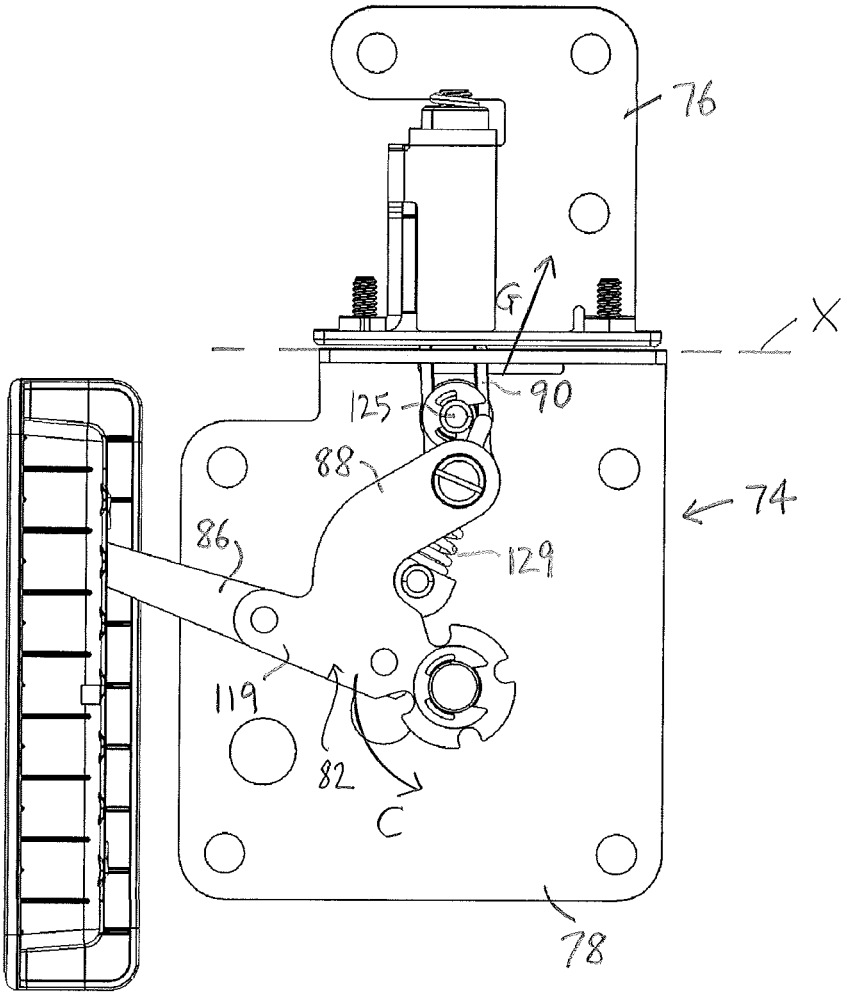
FIG. 10 is a side view of an embodiment of the latch assembly of the invention in a locked condition thereof, drawn at a larger scale.

Those skilled in the art would appreciate that, in practice, there may be situations where the only feasible movement onto the seat subassembly, or from the seat subassembly, would be substantially horizontal. In order to control movement of the upper portion, a latch assembly 74 preferably is located in each of the left and right arm assemblies 58, 60 (FIG. 10). It is preferred that the latch assembly 74 is movable between locked and unlocked conditions thereof, as will be described. Preferably, the latch assembly 74 is configured to secure the upper portion 64 in the aligned position when the latch assembly 74 is in the locked condition, and the latch assembly 74 is also configured to permit the upper portion 64 to move to the non-aligned position when the latch assembly 74 is in the unlocked condition.

The latch assembly 74 that is mounted in the upper and lower portion bodies 66, 70 of the right arm assembly 60 is illustrated in FIGS. 10-18. It will be understood that the latch assembly 74 that is mounted in the left arm assembly 58 is the mirror image thereof.

In one embodiment, the latch assembly 74 preferably includes an upper plate 76 secured to the upper portion body 66, and a lower plate 78 secured to the lower portion body 70. It is also preferred that the upper plate 76 and the lower plate 78 define the axis of rotation "X" therebetween.

The latch plates 76 that are mounted to the upper portions 64 of each of the left and right arm assemblies can be seen, for example, in FIG. 7.

Those skilled in the art would appreciate that, in one embodiment, the axis of rotation "X" preferably is also defined by the hinge subassembly 80 that is at least partially located between the upper and the lower plates 76, 78. The hinge subassembly 80 is omitted from FIGS. 10-18 for clarity of illustration. It will be understood that the hinge subassembly 80 may be in any suitable form. Those skilled in the art would be aware of suitable forms of hinge subassemblies.

Figure 11:
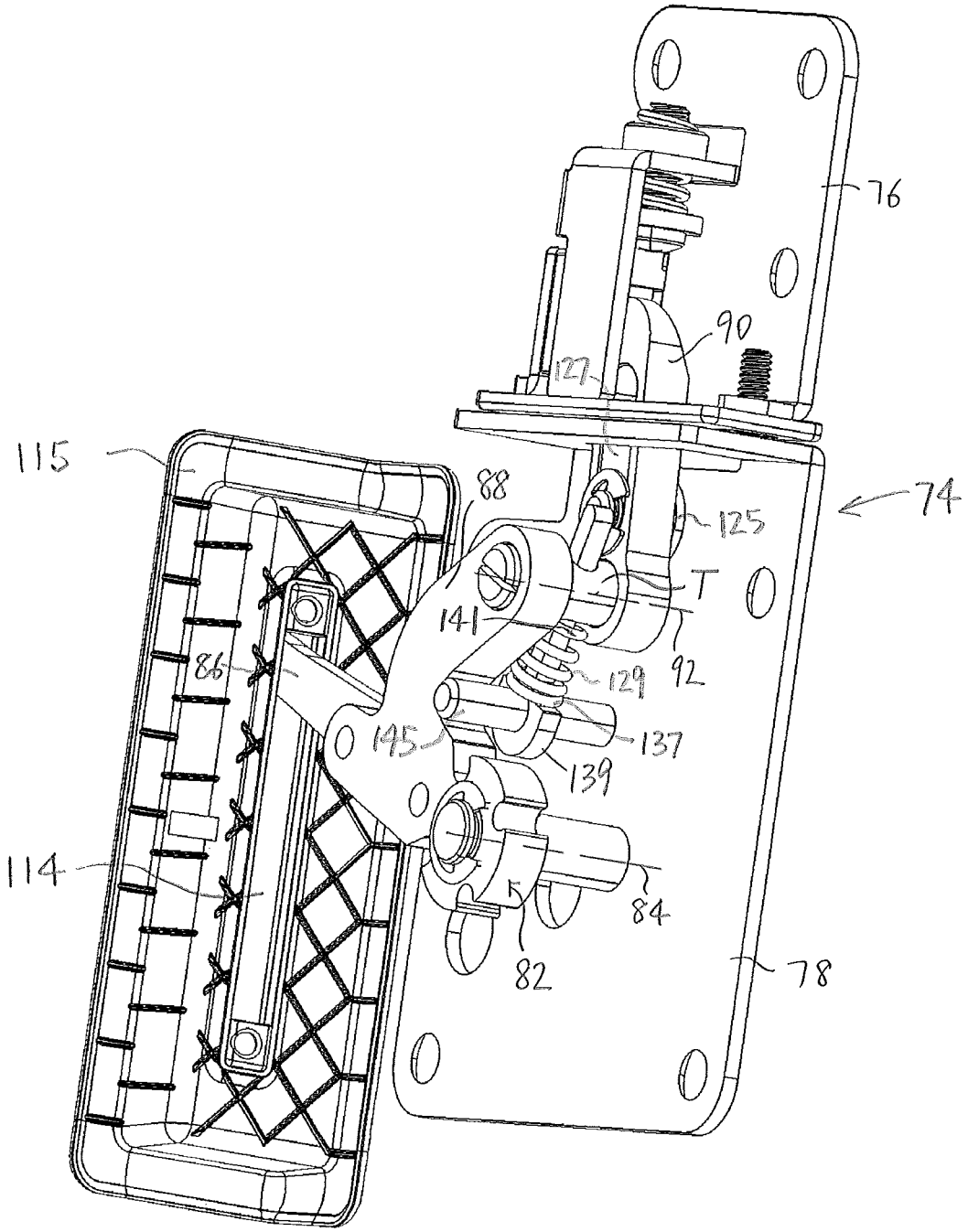
FIG. 11 is an isometric view of the latch assembly of FIG. 10, drawn at a larger scale.

In one embodiment, the latch assembly 74 preferably includes an activation element 82 mounted to the lower plate 78 and rotatable about an activation element axis 84 (FIG. 11). As can be seen in FIG. 10, the activation element 82 preferably includes a first arm 86 and a second arm 88. Preferably, the latch assembly 74 also includes a latch element 90 pivotally mounted to the second arm 88 and pivotable about a latch element axis 92 that is parallel to the activation element axis 84 (FIG. 11). The activation element 82 preferably is movable between a first position (FIG. 10), in which the latch assembly 74 is in the locked condition and the first arm 86 is positioned pointing at least partially upwardly, and a second position (FIG. 12), in which the latch assembly 74 is in the unlocked condition and the first arm 86 is positioned pointing at least partially downwardly. As will be described, movement of the activation element 82 from the first position to the second position thereof causes the latch assembly 74 to move from the locked condition to the unlocked condition thereof.

The direction of rotation of the activation element 82 from the first position to the second position is indicated by arrow "C" in FIG. 10.

When the upper portion 64 is in the aligned position (i.e., aligned vertically with the lower portion 62), movement of the activation element 82 from the second position thereof to the first position thereof moves the latch assembly 74 from its unlocked condition to its locked condition. The direction of rotation of the activation element 82 from the second position to the first position is indicated by arrow "D" in FIG. 12.

Figure 15:
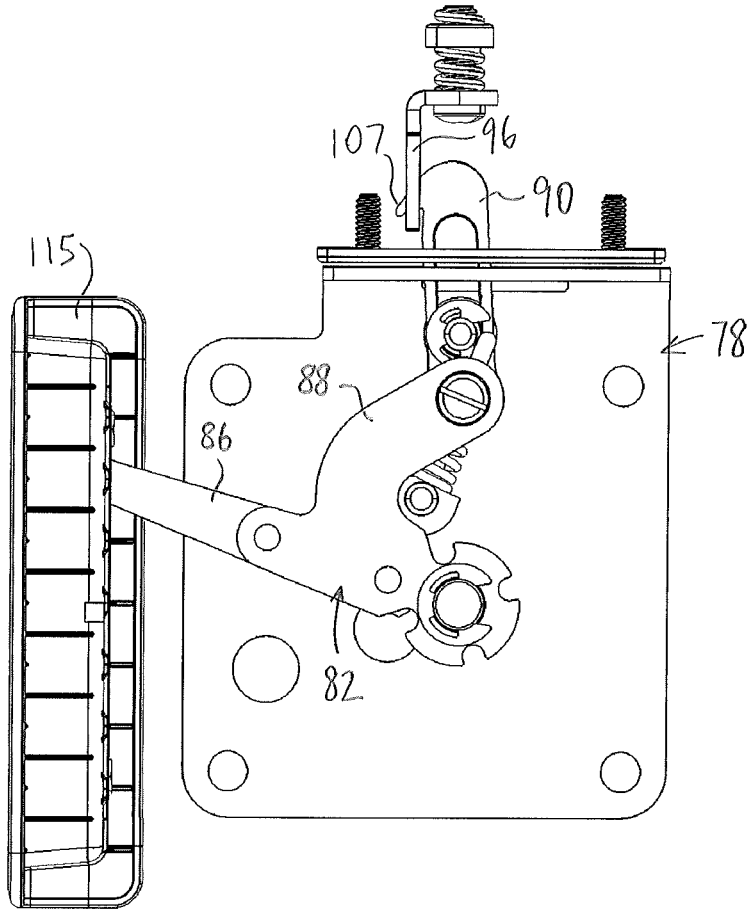
FIG. 15 is a side view of the latch assembly of FIG. 10 in a locked condition, with certain elements omitted.

The latch assembly 74 is shown in its locked condition in FIGS. 10, 11, and 15. When the latch element 90 is in a locked position thereof, the latch assembly 74 is in its locked condition. From the foregoing, it can be seen that, when the latch assembly 74 is in the locked condition thereof, the upper portion 64 is locked in the aligned position thereof relative to the lower portion 62. For example, in FIGS. 7 and 8, the upper portion 64 of the left arm assembly 58 is locked in the aligned position thereof relative to the lower portion 62 of the left arm assembly 58. For illustrative purposes, in FIGS. 7 and 8, the latch assembly 74 of the right arm assembly 60 is in the unlocked condition, which permits the upper portion 64 of the right arm assembly 60 to be in the non-aligned position relative to the lower portion 62 of the right arm assembly 60.

It will be understood that certain elements are omitted from FIG. 15 in order to show the location of the latch element 90 in relation to the upper plate 76, when the latch element 90 is in its locked position.

Similarly, the latch assembly 74 is shown in its unlocked condition in FIGS. 12, 13, 14, and 17. When the latch element 90 is in an unlocked position thereof, the latch assembly 74 is in its unlocked condition. It will also be understood that certain elements are omitted from FIGS. 13 and 17 in order to show the location of the latch element 90 in relation to the upper and lower plates 76, 78, when the latch element 90 is in its unlocked position.

Figure 12:
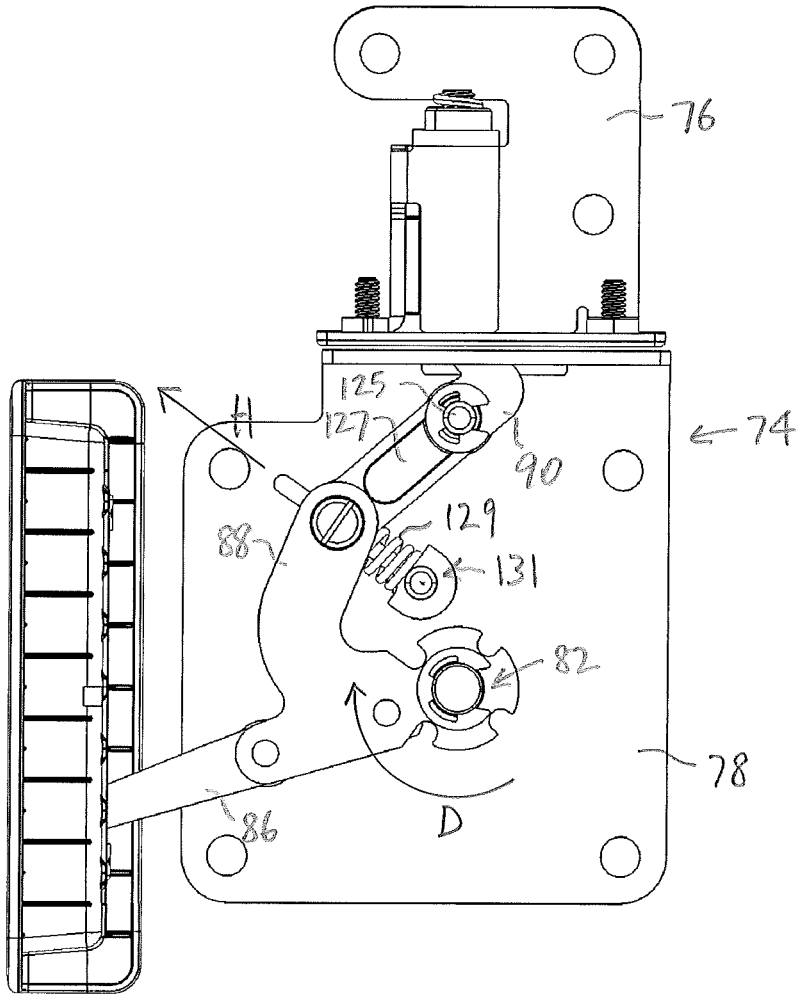
FIG. 12 is a side view of the latch assembly of FIG. 10 in an unlocked condition thereof, drawn at a smaller scale.

As can be seen, e.g., in FIGS. 10 and 12, the latch element 90 preferably is moved from the locked position thereof (FIG. 10) to the unlocked position thereof (FIG. 12) by rotation of the activation element 82 from the first position to the second position thereof respectively. The latch element 90 preferably is moved from the unlocked position thereof to the locked position thereof by rotation of the activation element 82 from the second position to the first position thereof.

Figure 18:
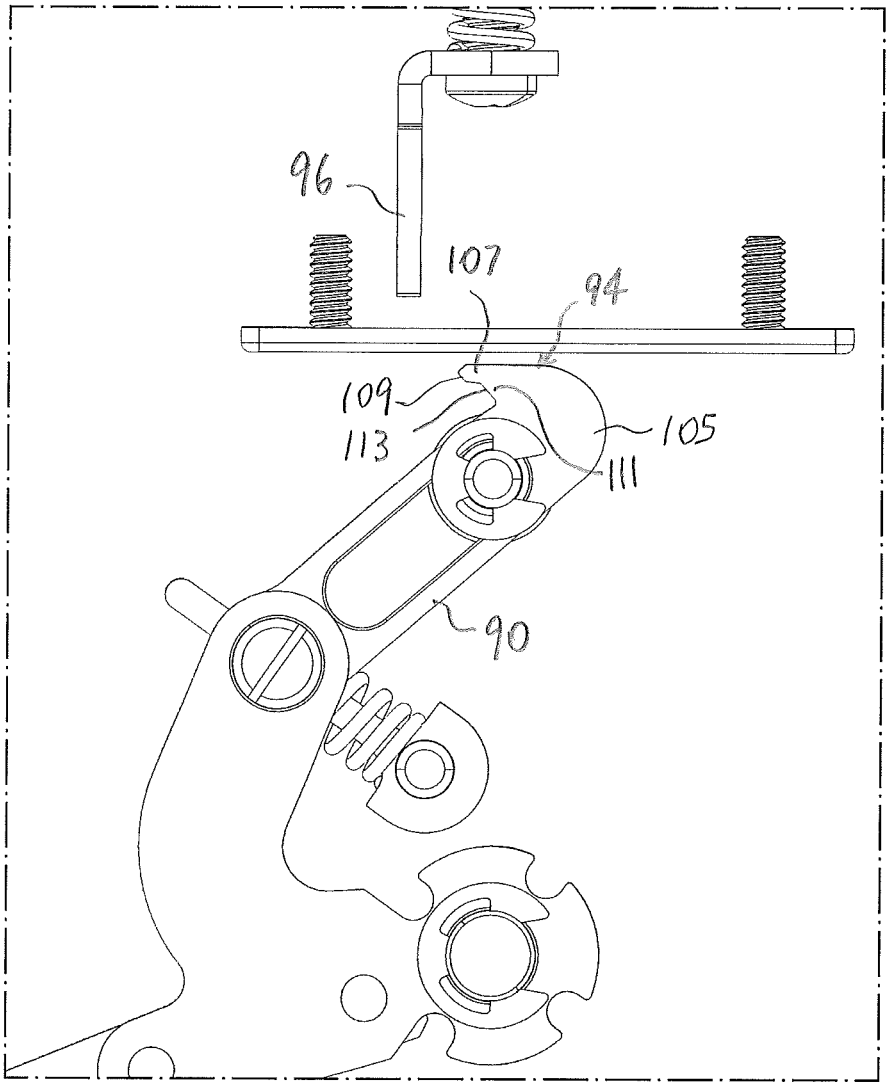
FIG. 18 is a side view of a portion of the latch assembly of FIG. 17, drawn at a larger scale.

As can be seen in FIG. 18, the latch element 90 preferably includes a hook portion 94 that engages with a stop 96 mounted to the upper plate 76, when the activation element 82 is in the first position thereof, and when the upper portion 64 is in the aligned position thereof. It will be understood that the upper plate 76 is omitted from FIGS. 15-18 for clarity of illustration. (As noted above, when the activation element 82 is in the first position thereof, the latch element 90 is in the locked position thereof.) Those skilled in the art would appreciate that the stop 96 may have any suitable configuration. As can be seen in FIGS. 16C and 16D, in one embodiment, the stop 96 preferably comprises a stop frame 98 that includes a lower ledge 101 with which the hook portion 94 is engageable. Preferably, the lower ledge 101 partially defines an opening 103 in the stop frame 98.

In one embodiment, the hook portion 94 preferably includes a hook body 105 and a point region 107 extending from the body 105, to define a protruding region 109 that is protruding or proud relative to a recessed region 111, that extends from the point region 107 toward the body 105. The recessed region 111 is partly defined by an edge 113. It will be understood that, when the hook portion 94 engages the lower ledge 101, the edge 113 engages the lower ledge 101, and the protruding region 109 tends to hold the hook portion 94 engaged with the stop 96. Preferably, when the edge 113 engages the lower ledge 101, the point region 107 at least partially extends into the opening 103 (FIG. 15)

Those skilled in the art would appreciate that the hook portion 94 and the lower ledge 101 are configured and positioned relative to each other so that, when the latch element 90 is in its locked position, the hook portion 94 is unlikely to be inadvertently removed from engagement with the lower ledge 101, e.g., if the upper portion 64 is jarred by an object striking it.

As can be seen in FIGS. 10, 11, and 15, when the activation element 82 is in the first position thereof, the first arm 86 preferably is in an uppermost position thereof. Also, and as can be seen in FIGS. 12, 13, 14, and 17, when the activation element 82 is in the second position thereof, the first arm 86 preferably is in a lowermost position thereof. In addition, however, the first arm 86 preferably is positionable at a first arm intermediate position, between the uppermost and lowermost positions thereof, as can be seen in FIGS. 16A-16D. When the first arm is in the first arm intermediate position, the latch element 90 is located by the activation element 82 in an intermediate position thereof in which the hook portion 94 is disengaged from the stop 96, and positioned above the lower portion 62.

Figure 16A:
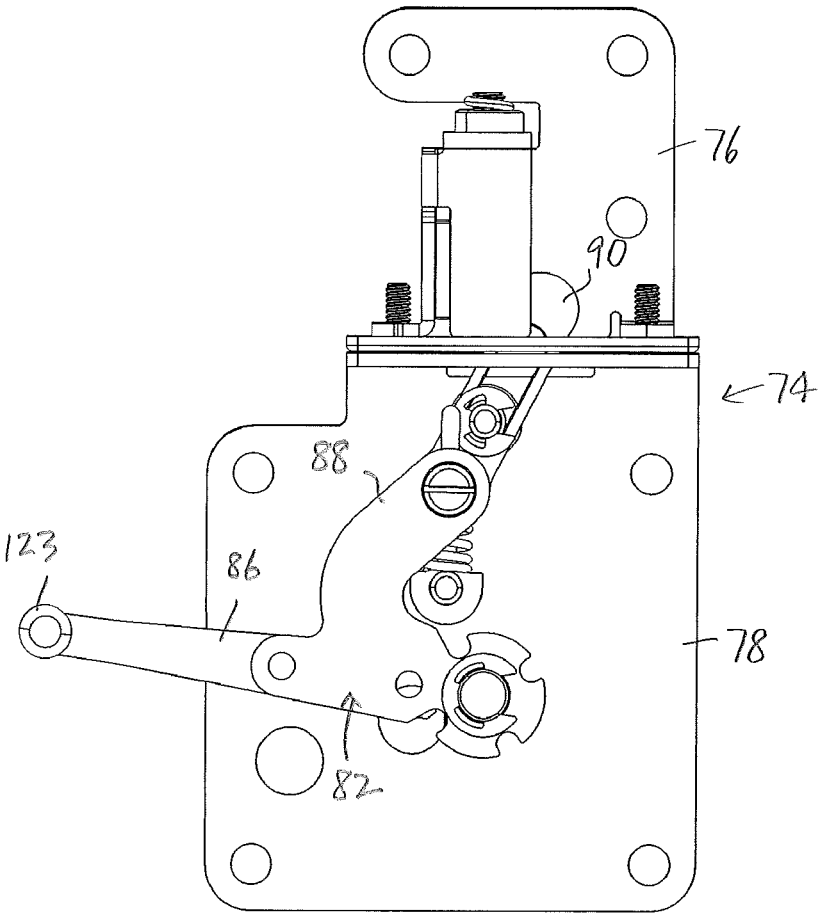
FIG. 16A is a side view of the latch assembly of FIGS. 10-15 in an intermediate condition.
Figure 16B:
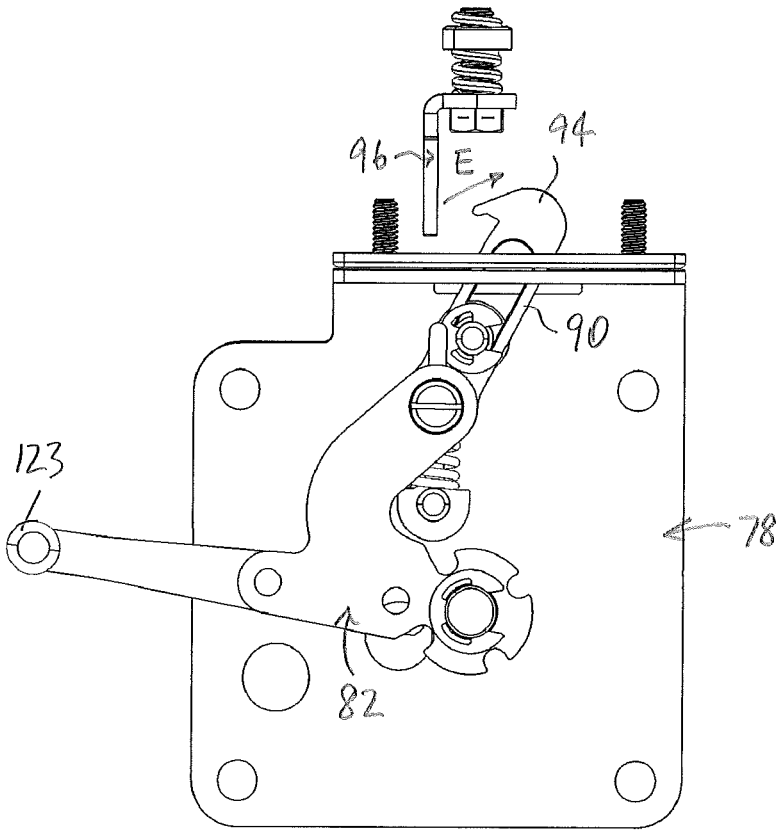
FIG. 16B is a side view of the latch assembly of FIG. 16A with certain elements omitted.
Figure 16C:
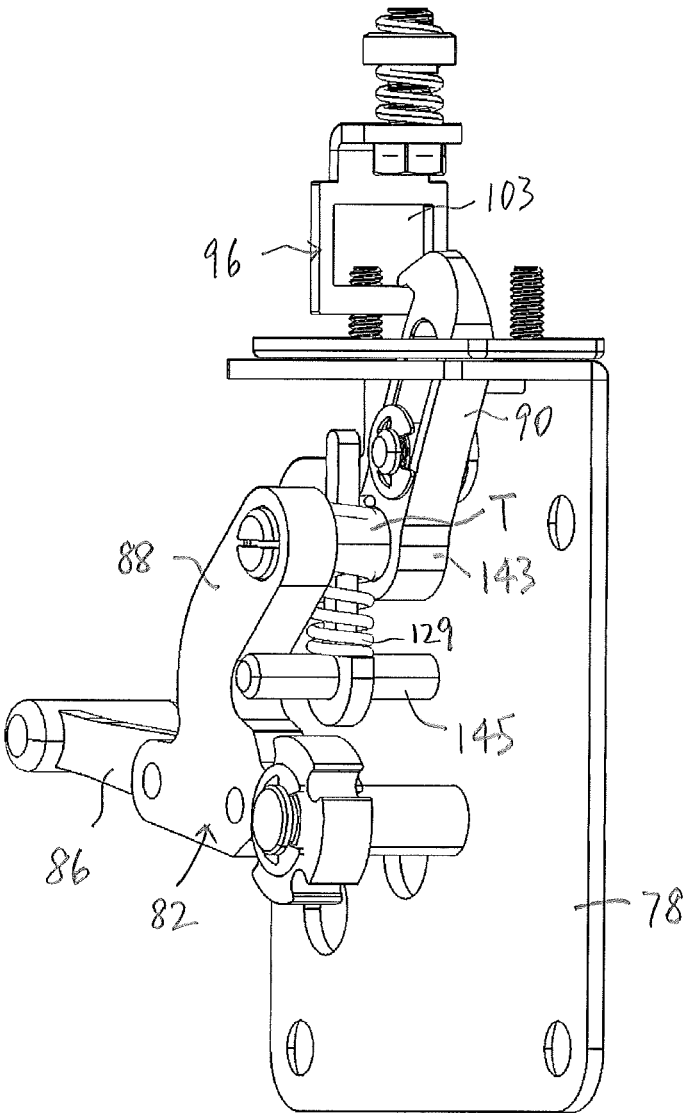
FIG. 16C is an isometric view of the latch assembly of FIG. 16B.
Figure 16D:
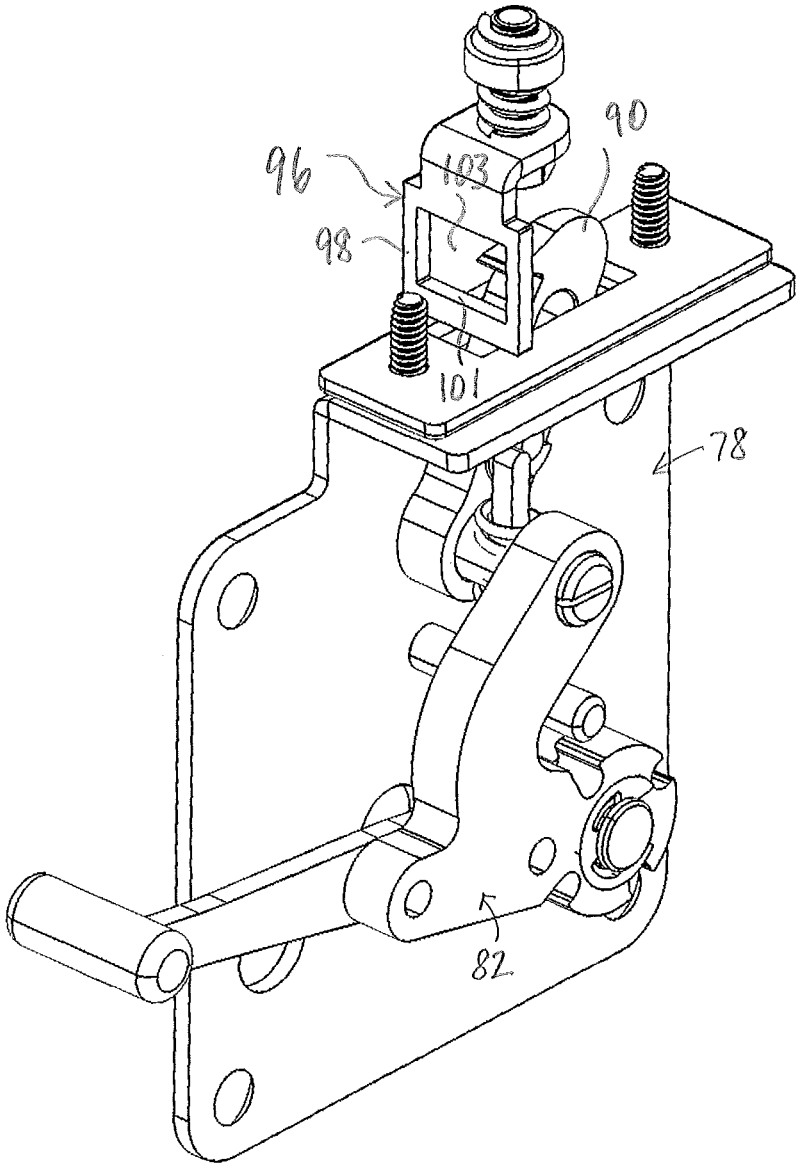
FIG. 16D is another isometric view of the latch assembly of FIGS. 16B and 16C.
Figure 17:
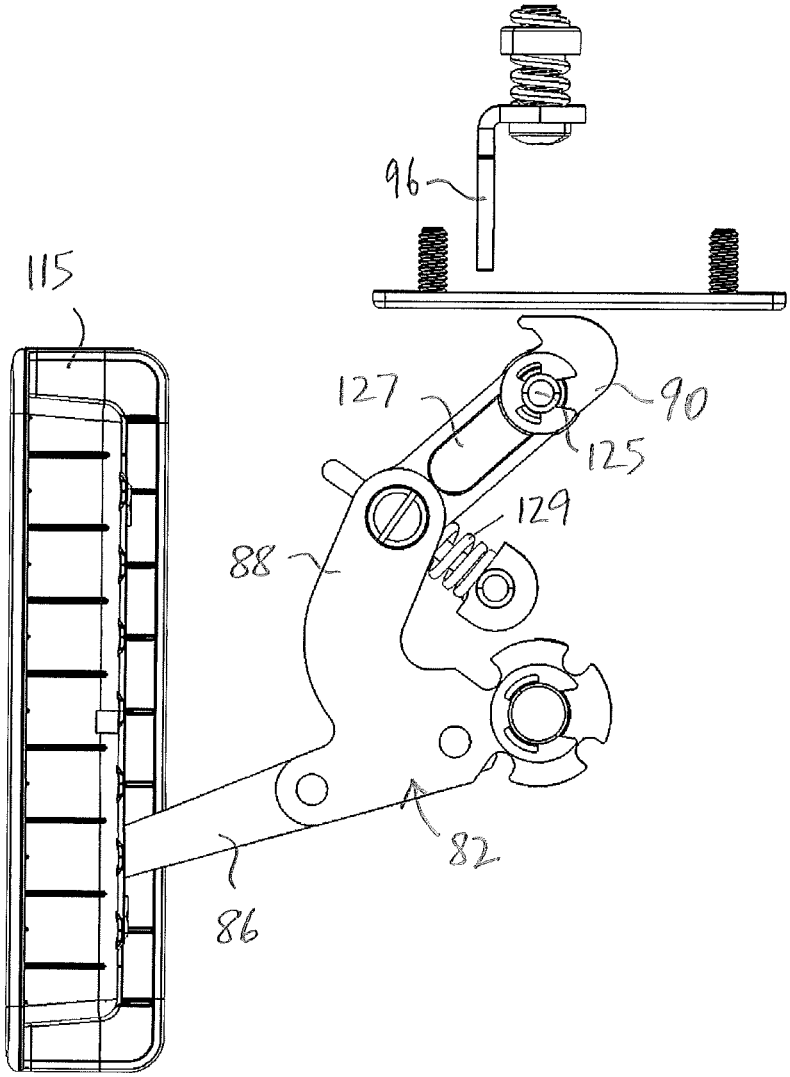
FIG. 17 is a side view of the latch assembly in the unlocked condition thereof, with certain elements omitted.

As can be seen in FIGS. 15 and 16B, in which the latch element 90 is shown in the locked position and the intermediate position thereof respectively, when the latch element 90 is moved from the locked position to the intermediate position, the hook portion 94 is pivoted slightly upwardly, as indicated by arrow "E" in FIG. 16B. This upward pivoting movement is needed for disengagement so that the protruding region 109 can clear the lower ledge 101, thereby disengaging the edge 113 from the lower ledge 101.

It will be understood that the upper plate 76 is omitted from FIGS. 16A-16D for clarity of illustration. It can be seen, e.g., in FIG. 16B that when the activation element 82 is in the intermediate position thereof, the hook portion 94 of the latch element 90 is located in the upper portion 64, even though the hook portion 94 is disengaged from the stop 96 at that point.

Those skilled in the art would appreciate that, because the lower plate 78 and the upper plate 76 preferably are mounted inside the lower portion body 70 and the upper portion body 66 respectively, it is preferred that the lower portion body 70 includes an opening 114 through which the first arm 86 partially protrudes, so that the operator may have access to the first arm 86, to move the first arm 86 as needed.

Figure 14:
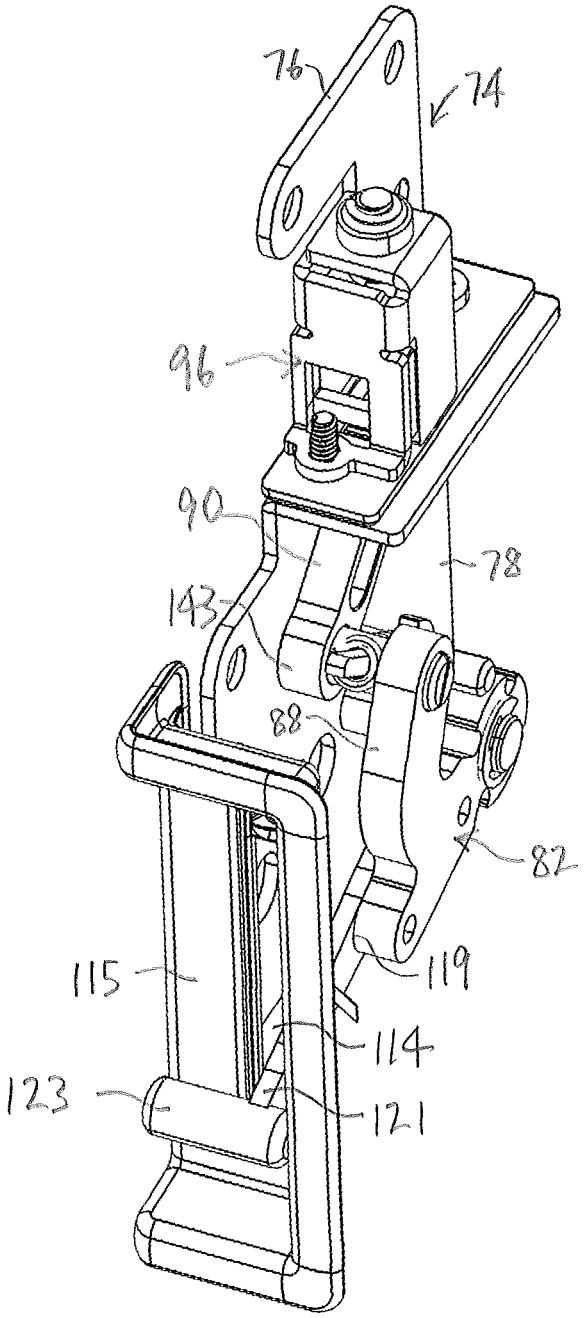
FIG. 14 is an isometric view of the latch assembly of FIG. 12.

As can be seen in FIGS. 11 and 14, in one embodiment, it is preferred that the lower portion body 70 includes a front exterior surface element 115 in which the opening 114 is formed. Preferably, the first arm 86 extends between an inner end 119 (FIG. 10) at which the first arm 86 is connected to the second arm 88, and an outer end 121 (FIG. 14) that is distal to the second arm 88. It is also preferred that the outer end 121 extends from the lower portion body 70 through the opening 114 to expose a terminal portion 123 of the outer end 121 (FIG. 14). As can also be seen in FIG. 14, in one embodiment, the terminal portion 123 preferably includes a knob or similar element, to enable the operator to easily grasp the terminal portion 123.

Figure 13:
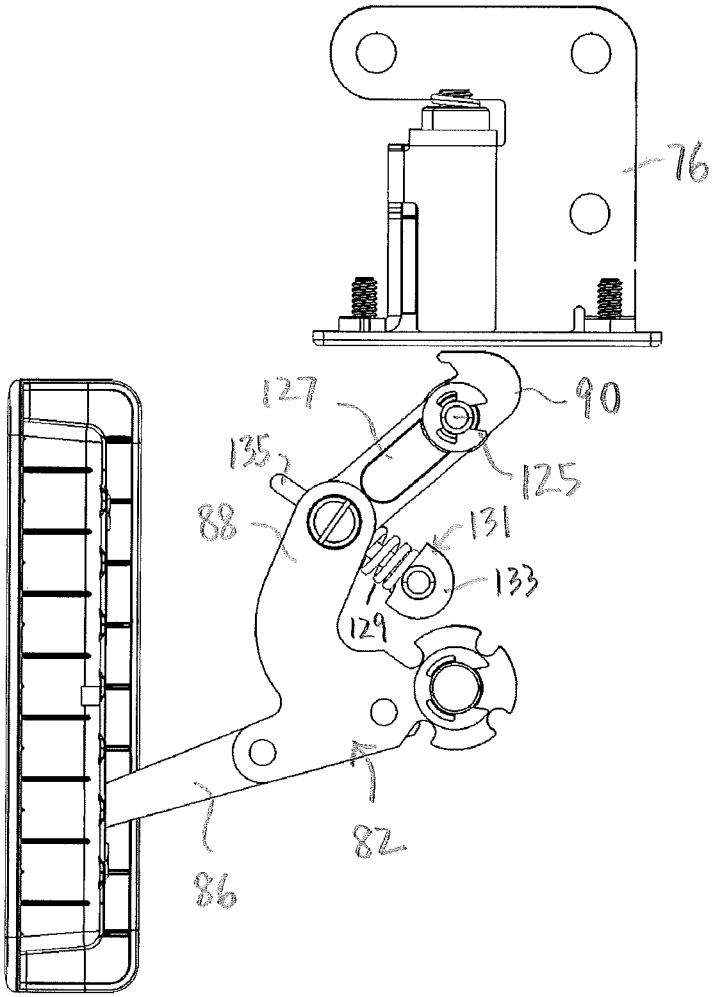
FIG. 13 is a side view of the latch assembly of FIG. 12, with a lower plate omitted.

In one embodiment, the latch assembly 74 preferably also includes a key element 125 connected to the lower plate 78 (FIG. 11) and slidably engaged in a slot 127 in the latch element 90, for guiding the latch element 90 along a predetermined path as the latch element 90 is moved between the locked and unlocked positions thereof (FIGS. 10, 13).

Preferably, the latch assembly 74 additionally includes a resilient element 129 (FIG. 11) for biasing the latch element 90 to the locked position thereof when the activation element 82 is in the first position, and also for biasing the latch element 90 to the unlocked position thereof when the activation element 82 is in the second position thereof.

Those skilled in the art would appreciate that this is achieved by utilizing an over-center linkage arrangement. Preferably, the resilient element 129 is a helical compression spring (FIGS. 11, 13, 16C). It is also preferred that the latch assembly 74 includes a biasing pin element 131 extending between inner and outer ends 133,135 thereof (FIG. 13). The biasing pin element 131 preferably is rotatably mounted to the lower plate 78 at its inner end 133, and rotatably mounted at its outer end 135, via a rod "T" (FIG. 11), to the second arm 88 of the activation element 82. Preferably, the rod "T" defines the latch element axis 92. As can be seen in FIG. 11, the helical compression spring 129 preferably is positioned on the biasing pin element 131 for engaging a first end 137 of the helical compression spring 129 with a pin element body 139 located at the inner end 133 of the biasing pin element, and for engaging a second end 141 of the helical compression spring 129 with the rod "T" (FIG. 11), and thereby indirectly with the second arm 88 of the activation element 82. As a result, the helical compression spring 129 urges the second arm 88 in a first direction (indicated by arrow "G" in FIG. 10) to hold the latch element 90 in the locked position thereof when the activation element 82 is in the first position thereof, and the helical compression spring 129 urges the second arm 88 in a second direction (indicated by arrow "H" in FIG. 12) that radially diverges from the first direction, to hold the latch element 90 in the unlocked position thereof when the activation element 82 is in the second position thereof.

Those skilled in the art would appreciate that, when the first arm 86 is in the first arm intermediate position, the latch assembly 74 is not biased to its locked condition, or to its unlocked condition. Because the spring 129 is relatively less compressed between the rod "T" and the pin element body 139 when the activation element 82 is in the intermediate position thereof, the activation element 82 can relatively easily be moved therefrom to its first or second positions.

As can be seen in FIGS. 11 and 16C, the rod "T" preferably is positioned substantially orthogonally to the second arm 88, and also to the lower plate 78. It is also preferred that the rod "T" is pivotably mounted to a lower end 143 of the latch element 90 (FIG. 14), so that movement of the second arm 88 causes corresponding movement of the lower end 143 of the latch element 90. The biasing pin element 131 is pivotably mounted to a pivot pin 145 that is mounted to the lower plate 78 (FIGS. 11, 16C).

Figure 2A:
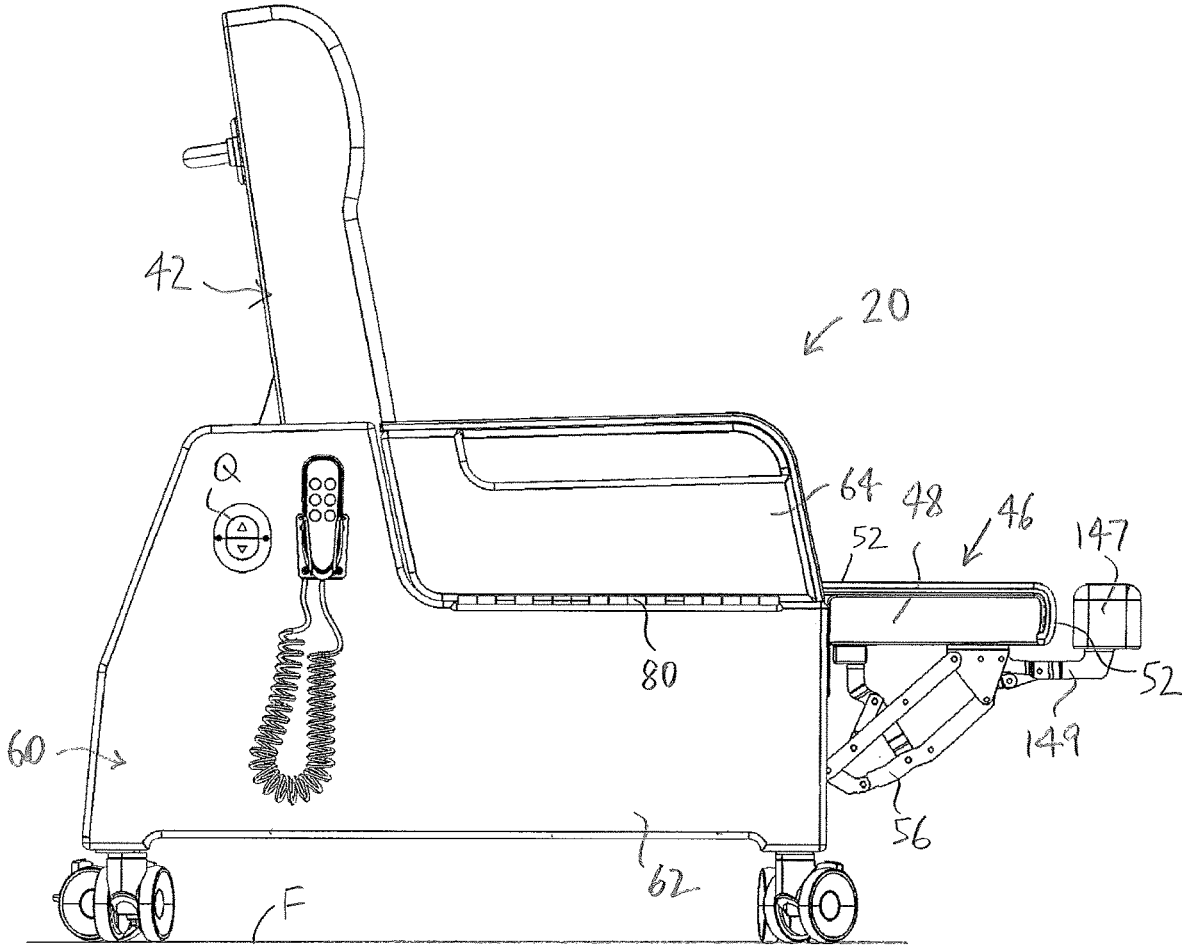
FIG. 2A is a right side view of the patient examination system of FIG. 1A in which a footrest subassembly is in an extended position thereof.
Figure 2B:
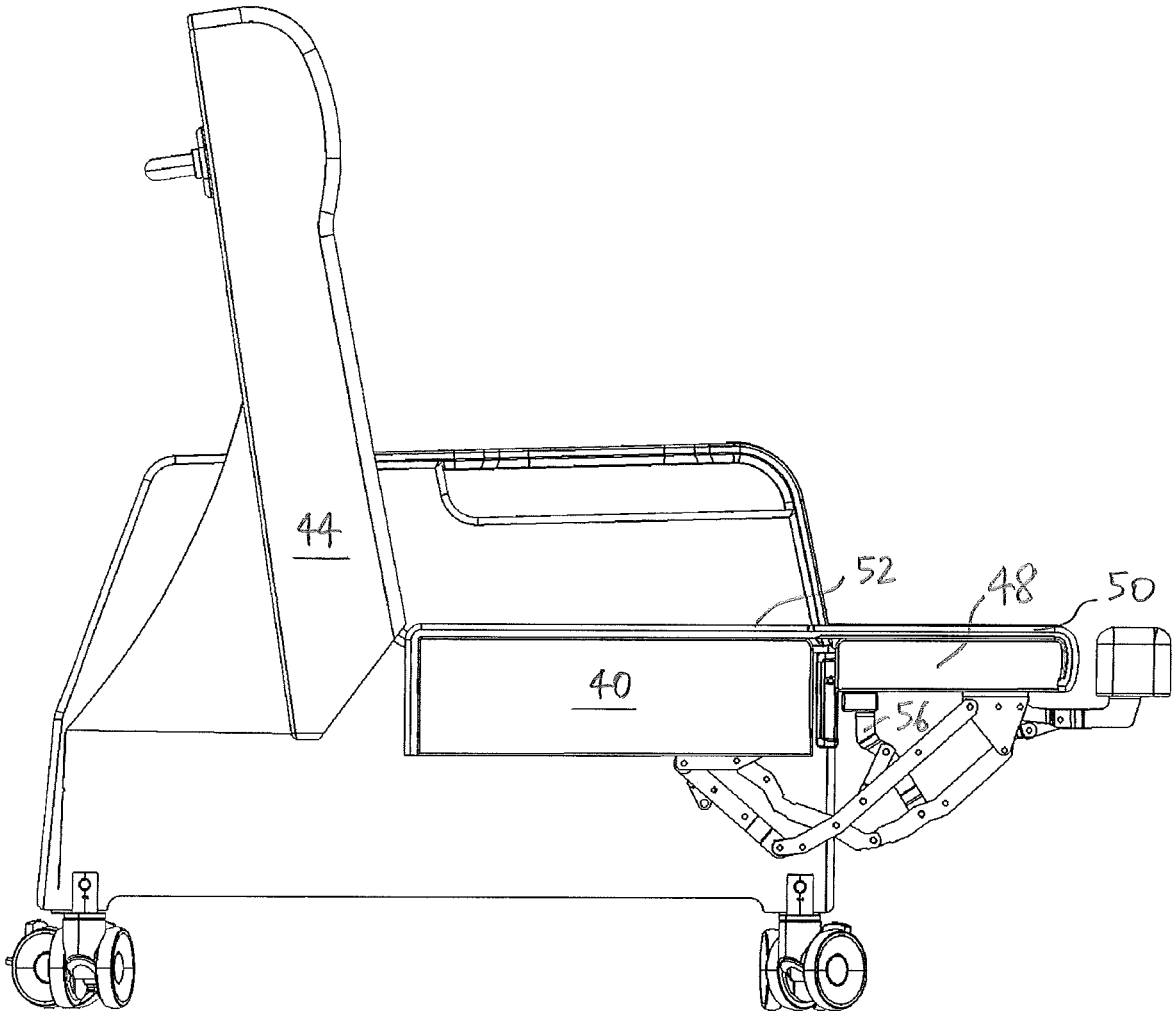
FIG. 2B is a right side view of the patient examination system of FIG. 2A, with certain elements omitted in order to show a seat subassembly and the footrest subassembly.

As can be seen, e.g., in FIG. 2A, in one embodiment, the footrest subassembly 46 preferably includes an auxiliary footrest cushion 147, supported by an auxiliary footrest linkage 149. The auxiliary footrest linkage is connected to the footrest linkage subassembly 56.

From the foregoing, it can be seen that the patient examination system 20 meets a number of the guidelines provided pursuant to the ADA.

Some of the guidelines provided pursuant to the ADA are discussed below.

A. Back Recline: The system 20 provides a motorized recline with infinite stops to full flat (horizontal) position, with the patient's head and back supported through the entire range of incline, as recommended pursuant to the ADA.

B. Ottoman: As noted above, the system 20 preferably includes a motorized ottoman (i.e., the footrest subassembly 46) with infinite stops to full flat (horizontal) position.

C. Sleep Position: The patient examination system 20 provides a fully flat sleep surface "S" at a relatively low height above the floor "F" (FIG. 3B). For example, in one embodiment, the sleep surface "S" may be at a minimum 19" height, adjustable higher by motorized lift. The minimum distance 151 of the sleep surface "S" above the floor "F" (FIG. 3B) preferably is not more than 19". For the purposes hereof, it is understood that the sleep surface "S" includes the exposed surface 152 of the cover element 150 and an outer surface "J" (FIGS. 3B, 5C) of the back cushion 44.

D. Exam Position: The patient examination system 20 provides a motorized lift with up to 400 lb. capacity, with infinite stops to full flat (horizontal) exam position to a maximum of 32" in height. The distance 153 of the sleep surface "S" above the floor "F" (FIG. 5C) preferably is up to 32".

E. Seated Transfer Height: In the system 20, this is a 19" minimum above the floor F. Seated Transfer Surface: Preferably, the seated transfer surface is a minimum of 30" wide×21.5" deep.

G. Transfer Arms: As noted above, the upper portions 64 of the left and right arm assemblies 58, 60 are hinged to permit unobstructed transfer.

H. Armrests: These serve as transfer support and rail within reach of transfer surface and respectively resist vertical and horizontal forces of 250 lbs.

I. Base: As can be seen in FIG. 3B, the system 20 provides for a clearance distance "P" above the support surface "F" that is relatively large. Preferably, the clearance distance "P" is a minimum of 6". This enables a portable patient lift to be accommodated.

J. Stirrups: The system 20 includes optional removable stirrups 155 (FIG. 6), to provide a method for supporting, positioning and securing the patient's legs.

K. Stirrup Storage: The system 20 includes built-in stirrup storage at the rear of unit.

L. Continuous Footrest: A cushioned footrest (i.e., the footrest subassembly, and the seat subassembly) includes the cover element 50 having a single surface from the back of the seat to the bottom of the footrest cushion 48.

M. Controller: The controller "Q" may include a pendant control accessible by the patient and the operator, and also a separate lift button for controlling vertical movement.

N. Power Connection Device: The system 20 may include a power connection device, which may include a USB port.

O. Optional Steel Legs or Independently Locking Casters: As illustrated, the legs include casters. It will be understood that the legs may, optionally, not include casters.

P. Optional Push Bar: As can be seen in FIG. 1A, the system 20 may include a push bar 157 positioned on the back subassembly 42.

Q. Armrests: The armrests 73 of the left and right arm assemblies 58, 60 may be upholstered, urethane, or have solid surfaces.

It will be appreciated by those skilled in the art that the invention can take many forms, and that such forms are within the scope of the invention as claimed. The scope of the claims should not be limited by the preferred embodiments set forth in the examples, but should be given the broadest interpretation consistent with the description as a whole.

We claim:

1. A patient examination system for locating a patient above a floor supporting the patient examination system, the patient examination system comprising:

a frame assembly comprising at least one lower element at least partially defining a lower side of the frame assembly located proximal to the floor;

at least one motion-controlling assembly connected to the frame assembly for moving at least one selected movable portion of the frame assembly relative to the floor;

said at least one selected movable portion comprising an upper element defining an upper side of the frame assembly located distal to the floor, the upper element being movable by said at least one motion-controlling assembly relative to the lower element;

a patient support assembly comprising:

a seat subassembly comprising a seat cushion;

a back subassembly comprising a back cushion;

a footrest subassembly comprising a footrest cushion;

a cover element covering the seat cushion and the footrest cushion, the cover element having an exposed surface engageable by the patient;

the seat subassembly being secured to the upper element of the frame assembly, the frame assembly being configured to support the seat subassembly relative to the floor in a lowered position thereof, in a raised position thereof, in intermediate seat positions therebetween, and in at least one Trendelenburg position;

the back subassembly being connected with the upper element by a back linkage subassembly, the back linkage subassembly being configured to support the back subassembly relative to the frame assembly in a non-horizontal position thereof, in a horizontal position thereof, in intermediate back positions therebetween, and in at least one Trendelenburg position;

the footrest subassembly being connected to the upper element of the frame assembly by a footrest linkage subassembly, the footrest linkage subassembly supporting the footrest cushion, the footrest linkage subassembly being configured to support the footrest subassembly relative to the seat subassembly in a retracted position thereof in which the footrest cushion is positioned orthogonally to the upper element, and in an extended position thereof, in which the footrest cushion is positioned parallel to the upper element;

said at least one motion-controlling assembly being configured to move the upper element vertically relative to the floor between lowered and raised positions thereof, wherein the vertical movement of the upper element causes corresponding vertical movement of the seat subassembly, the back subassembly, and the footrest subassembly;

a left arm assembly and a right arm assembly positioned on opposite sides of the seat subassembly, each of the left and the right arm assemblies being secured to the lower element of the frame assembly;

each of the left and right arm assemblies comprising:

a lower portion secured to the lower element of the frame assembly; and an upper portion movable relative to the lower portion between an aligned position thereof, in which the upper portion is at least partially vertically aligned with the lower portion above the lower portion, and a non-aligned position thereof, in which the upper portion is at least partially located beside the lower portion;

the upper portion being movable between the aligned and non-aligned positions by pivoting about an axis of rotation;

the upper portion comprising an upper portion body with an upper portion mating surface and the lower portion comprising a lower portion body with a lower portion mating surface that is formed to mate with the upper portion mating surface when the upper portion is in the aligned position;

when the upper portion is in the non-aligned position and the seat subassembly is in the lowered position, the upper portion mating surface and the lower portion mating surface are laterally aligned with each other, and with at least part of the exposed surface of the cover element;

a latch assembly movable between locked and unlocked conditions thereof, the latch assembly being configured to secure the upper portion in the aligned position when the latch assembly is in the locked condition, and the latch assembly being configured to permit the upper portion to move to the non-aligned position when the latch assembly is in the unlocked condition;

the latch assembly comprising an upper plate secured to the upper portion body, and a lower plate secured to the lower portion body;

the upper plate and the lower plate defining the axis of rotation therebetween;

the latch assembly comprising:

an activation element mounted to the lower plate and rotatable about an activation element axis, the activation element comprising a first arm and a second arm;

a latch element pivotally mounted to the second arm and pivotable about a latch element axis that is parallel to the activation element axis; and the activation element being selectively movable between a first position, in which the latch assembly is in the locked condition and the first arm is positioned pointing at least partially upwardly, and a second position, in which the latch assembly is in the unlocked condition and the first arm is positioned pointing at least partially downwardly, wherein movement of the activation element from the first position to the second position causes the latch assembly to move from the locked condition to the unlocked condition thereof.

2. The patient examination system according to claim 1 in which, when the upper portion is in the aligned position, movement of the activation element from the second position to the first position thereof moves the latch assembly from the unlocked condition to the locked condition.

3. The patient examination system according to claim 2 in which the latch element is moved from a locked position to an unlocked position thereof by rotation of the activation element from the first position to the second position respectively, and the latch element is moved from the unlocked position to the locked position by rotation of the activation element from the second position to the first position thereof.

4. The patient examination system according to claim 3 in which the latch element comprises a hook portion that engages with a stop mounted to the upper plate, when the activation element is in the first position thereof.

5. The patient examination system according to claim 4 in which:

when the activation element is in the first position thereof, the first arm is in a uppermost position thereof, and when the activation element is in the second position thereof, the first arm is in a lowermost position thereof;

the first arm is positionable at a first arm intermediate position, between the uppermost and lowermost positions thereof; and when the first arm is in the first arm intermediate position, the latch element is located by the activation element in an intermediate position thereof in which the hook portion is disengaged from the stop and positioned above the lower portion.

6. The patient examination system according to claim 5 in which:

the lower portion body has a front exterior surface in which an opening is formed;

the first arm extends between an inner end at which the first arm is connected to the second arm and an outer end that is distal to the second arm; and the outer end extends from the lower portion body through the opening to expose a terminal portion of the outer end.

7. The patient examination system according to claim 6 in which the latch assembly additionally comprises a key element connected to the lower plate and slidably engaged in a slot in the latch element, for guiding the latch element along a predetermined path as the latch element is moved between the locked and unlocked positions thereof.

8. The patient examination system according to claim 7 in which the latch assembly additionally comprises a resilient element for biasing the latch element to the locked position thereof when the activation element is in the first position, and for biasing the latch element to the unlocked position thereof when the activation element is in the second position thereof.

9. The patient examination system according to claim 8 in which:

the resilient element comprises a helical compression spring;

the latch assembly additionally comprises:

a biasing pin element extending between inner and outer ends thereof, the biasing pin element being rotatably mounted to the lower latch plate at its inner end and rotatably mounted at its outer end, via a rod, to the second arm of the activation element;

the helical compression spring being positioned on the biasing pin element for engaging a first end of the helical compression spring with a pin element body located at the inner end of the biasing pin element and for engaging a second end of the helical compression spring with the rod, and indirectly with the second arm of the activation element, wherein the helical compression spring urges the second arm in a first direction to hold the latch element in the locked position thereof when the activation element is in the first position thereof, and the helical compression spring urges the second arm in a second direction that radially diverges from the first direction to hold the latch element in the unlocked position thereof when the activation element is in the second position thereof.

* * * * *